US009360780B2

(12) United States Patent
Suzuki et al.

(10) Patent No.: US 9,360,780 B2
(45) Date of Patent: Jun. 7, 2016

(54) TONER, TWO-COMPONENT DEVELOPER, TONER SET, TONER CONTAINER, PRINTED MATTER, IMAGE FORMING APPARATUS, AND IMAGE FORMING METHOD

(71) Applicants: Kazumi Suzuki, Shizuoka (JP); Yoshitaka Yamauchi, Shizuoka (JP)

(72) Inventors: Kazumi Suzuki, Shizuoka (JP); Yoshitaka Yamauchi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 104 days.

(21) Appl. No.: 14/200,344

(22) Filed: Mar. 7, 2014

(65) Prior Publication Data

US 2014/0272690 A1 Sep. 18, 2014

(30) Foreign Application Priority Data

Mar. 13, 2013 (JP) ..... 2013-049925

(51) Int. Cl.

*G03G 9/087* (2006.01)
*G03G 9/08* (2006.01)
*G03G 15/20* (2006.01)

(52) U.S. Cl.

CPC ..... *G03G 9/0821* (2013.01); *G03G 9/08755* (2013.01); *G03G 9/08764* (2013.01); *G03G 9/08795* (2013.01); *G03G 9/08797* (2013.01); *G03G 15/2039* (2013.01); *G03G 2215/0607* (2013.01)

(58) Field of Classification Search

CPC ..... G03G 9/08755; G03G 90/8795; G03G 9/08797; G03G 13/08; G03G 9/0821
USPC ..... 430/109.4, 111.4, 123.5
See application file for complete search history.

(56) References Cited

U.S. PATENT DOCUMENTS 5,180,649 A * 1/1993 Kukimoto ..... G03G 9/0821 430/108.23
5,840,457 A * 11/1998 Urawa ..... G03G 9/0825 430/108.8
5,955,234 A * 9/1999 Matsunaga ..... C08F 257/00 430/109.3
8,043,782 B2 * 10/2011 Jeong ..... G03G 9/0821 430/111.4
8,728,696 B2 * 5/2014 Yamada ..... G03G 9/0821 430/107.1
8,741,529 B2 * 6/2014 Aoki ..... G03G 15/0189 430/109.4
2007/0281235 A1 * 12/2007 Ono ..... C08G 63/20 430/111.4

FOREIGN PATENT DOCUMENTS

JP 2003-167384 6/2003
JP 2004-264320 9/2004

OTHER PUBLICATIONS

Owens, David. Copies in Seconds. New York: Simon and Schuster Paperbacks (2004) pp. 166-175.*

* cited by examiner

*Primary Examiner* — Christopher Rodee
(74) *Attorney, Agent, or Firm* — Oblon, McClelland, Maier & Neustadt, L.L.P.

(57) ABSTRACT

To provide a toner, containing: a noncrystalline resin; and a crystalline resin, wherein the crystalline resin has a weight average molecular weight of 100,000 to 180,000, wherein a temperature range of the toner, within which a loss tangent (tan δ) as measured by a dynamic viscoelasticity measurement is 6 or greater, is 20° C. or greater, and wherein a fixed toner image has 60° glossiness of 30 to 50, where the fixed toner image is obtained by forming an unfixed toner image having a deposition amount of 0.4 mg/cm$^2$ on a recording medium having 60° glossiness of 30 for a measurement, and fixing at temperature at which temperature of the toner image is a lowest temperature of the temperature range +10° C., at 0.15 MPa, for a nipping duration of 50 msec.

9 Claims, 3 Drawing Sheets

TONER, TWO-COMPONENT DEVELOPER, TONER SET, TONER CONTAINER, PRINTED MATTER, IMAGE FORMING APPARATUS, AND IMAGE FORMING METHOD

CROSS-REFERENCE TO RELATED APPLICATIONS

This application is based upon and claims the benefit of priority to Japanese Application No. 2013-049925 filed on Mar. 13, 2013, the entire contents of which is incorporated herein by reference.

BACKGROUND OF THE INVENTION

1. Field of the Invention

The present invention relates to a toner, a two-component developer, a toner set, a toner container, printed matter, an image forming apparatus, and an image forming method.

2. Description of the Related Art

As for an electrophotographic image forming method, various methods have been known conventionally.

In the image forming method, typically, an electric latent image is formed on a photoconductor, the electric latent image is developed with a toner, the toner image as formed is transferred onto a recording medium, followed by fixing the toner image with heating, pressuring, heating and pressurizing, or solvent vapor, to thereby obtain the fixed toner image (see, for example, U.S. Pat. No. 2,297,691, and Japanese Patent Publication Application (JP-B) Nos. 42-23910, and 43-24748).

Recently, a color image forming apparatus and color image forming method employing the electrophotographic system have been widely spread. Associating with the fact that a digital image is easily obtained, there is a need for further improving an image quality of a printed image by the color image forming apparatus and color image forming method. Especially, there is a demand for image formation of high image quality applicable for digital printing.

However, a conventional color image formed by the electrophotographic system has not been sufficiently achieved an image quality compared to a quality of a color image formed by silver halide photography, or printing. This is because the conventional color image formed by the electrophotographic system cannot attain both excellent chroma, and excellent visibility. It is extremely difficult particularly for a color image of secondary or higher color to achieve both excellent chroma, and excellent visibility.

According, it is currently desired to provide a toner, which has excellent thermal characteristics, and can produce a secondary color having excellent chroma and visibility.

SUMMARY OF THE INVENTION

The present invention aims to solve the aforementioned various problems in the art, and achieve the following object. Specifically, an object of the present invention is to provide a toner having excellent thermal characteristics, and giving secondary color that is excellent in chroma and visibility.

The means for solving the aforementioned problems are as follows.

The toner of the present invention contains:

a noncrystalline resin; and a crystalline resin, wherein the crystalline resin has a weight average molecular weight of 100,000 to 180,000, wherein a temperature range of the toner, within which a loss tangent (tan δ) as measured by a dynamic viscoelasticity measurement is 6 or greater, is 20° C. or greater, and wherein a fixed toner image has 60° glossiness of 30 to 50, where the fixed toner image is obtained by forming an unfixed toner image having a deposition amount of 0.4 mg/cm$^2$ on a recording medium having 60° glossiness of 30 for a measurement, and fixing at temperature at which temperature of the toner image is a lowest temperature of the temperature range +10° C., at 0.15 MPa, for a nipping duration of 50 msec.

The present invention can solve the aforementioned various problems in the art, and can provide a toner having excellent thermal characteristics, and giving secondary color that is excellent in chroma and visibility.

DETAILED DESCRIPTION OF THE INVENTION (Toner)

Figure 1:
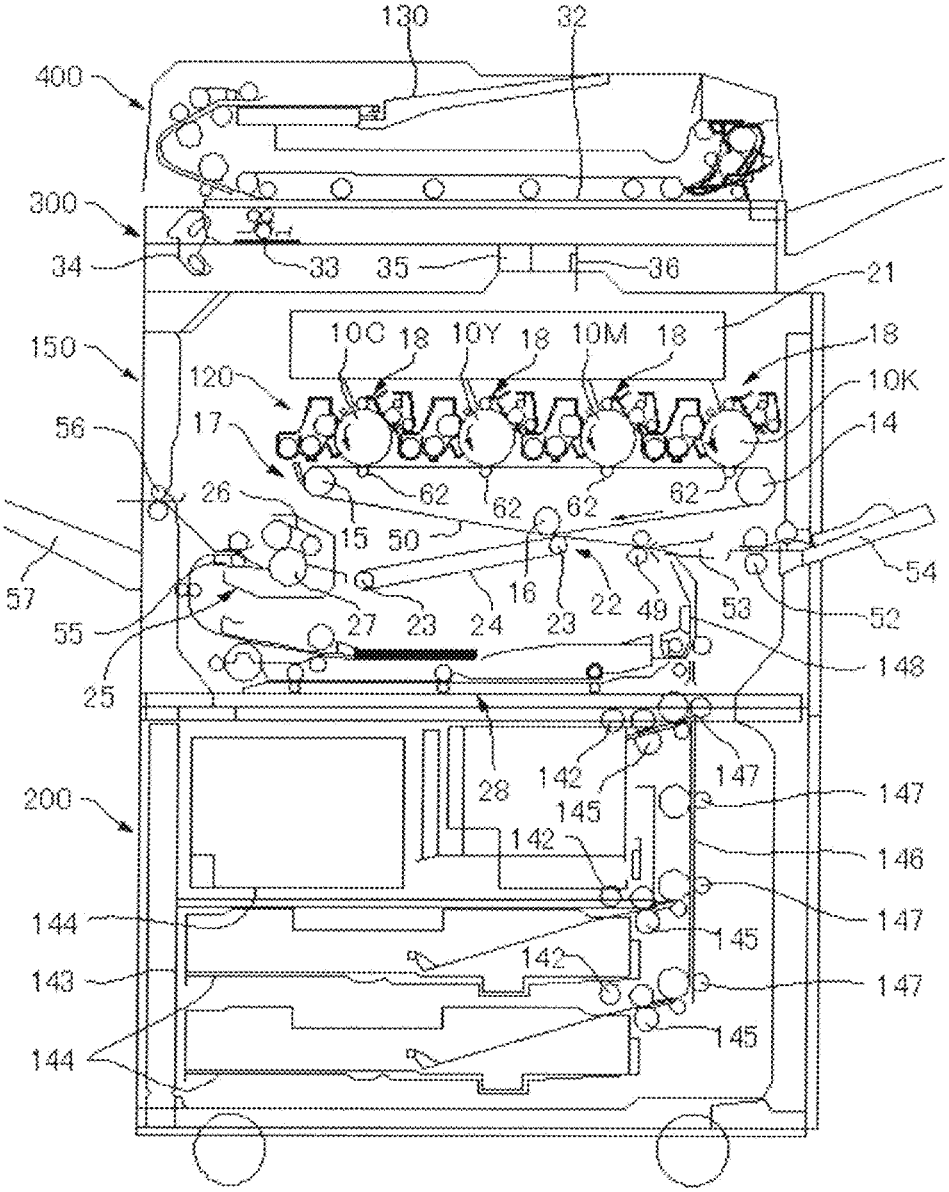
FIG. 1 is a schematic structure diagram illustrating one example of the image forming apparatus of the present invention.

The toner of the present invention contains at least a noncrystalline resin, and a crystalline resin, and may further contain other components according to the necessity.

The weight average molecular weight of the crystalline resin is 100,000 to 180,000.

The toner has a temperature region of 20° C. or more, where the temperature region is a temperature region, within which a loss tangent (tan δ) as measured by dynamic viscoelasticity measurement is 6 or greater.

The fixed toner image of the toner has 60° glossiness of 30 to 50, where the fixed toner image is obtained by forming an unfixed toner image on a recording medium for measurement, which has 60° glossiness of 30, with a deposition amount of 0.4 mg/cm$^2$, and fixing the toner image at temperature at which the temperature of the toner image is a temperature higher than the lowest temperature of the aforementioned temperature range by 10° C., at 0.15 MPa, for a nipping duration of 50 msec.

The present inventors have diligently conducted studies for attaining a toner, which can form an image a quality of which is not far from printed matter formed by silver halide photography or printing, has excellent thermal characteristics, and produces a secondary color having excellent chroma and visibility. As a result, the present inventors have come to the following insights.

In order to achieve a high image quality of a color image formed by electrophotographic system, which is not far from a quality of a color image formed by silver halide photography or printing, it is important how an unfixed toner image, which is a collection of powder, formed on a recording medium is turned into an image as a uniform film.

This is because chroma is reduced due to increased diffuse light or lack of absorbance, as more proportion of a toner, which is a powder, is present as grain aggregates in an image.

One of the factors for reducing chroma in an electrophotographic system is, for example, insufficient spreading of a lower layer (at the side of a base) toner, as a secondary color image, such as RGB, which is created by laminating a plurality of process toners on a base, is output. The chroma of the secondary color significantly reduces, in the state where a base is not sufficiently covered with the toner as the spreading of the lower layer toner is sufficient, and the toner is present with being scattered. The developing is a characteristic problem to an image forming method using a toner, which is a powder.

In the electrophotographic system, conventionally, the most coming fixing method is a pressure heating system using a heat roller or a heat belt. In the pressure heating system using a heat roller or heat belt, a toner image is fixed by passing through a sheet to be fixed while bringing a surface of the toner image of the sheet to be fixed into contact with a surface of the heat roller or heat belt having release properties to the toner under pressure. This method has extremely excellent thermal efficiency at the time when the toner image is fused on the sheet, as the surface of the heat roller or heat belt and the toner image on the sheet are brought into contact with pressure, and therefore fixing can be promptly performed.

In the case where the aforementioned pressure heating system is employed, there are methods, such as adjusting dynamic viscoelasticity of the toner, and increasing tan δ of the toner, in order to secure a spreading ability of a lower layer toner of a secondary color. However, the toner having large tan δ gives an image of excessively high glossiness, resulting in the image having glaring, and therefore the resulting image has low visibility although having high chroma.

An image formed by the electrophotographic system typically has variations in glossiness depending on a deposition amount of the toner. Especially, an area of a secondary color, or tertiary color, which has a large deposition amount, tends to give high glossiness, and therefore a resulting image has lower visibility, due to a gloss difference to other areas of low deposition amounts.

The present inventors have found out from the researches that it is important to make loss tangent (tan δ) of the toner, which is measured by dynamic viscoelasticity measurement, large, in order to secure a spreading ability of the toner (especially a spreading ability of the lower layer toner in a secondary or higher color).

Moreover, they have found out that an image having low visibility with high chroma is obtained of only tan δ of the toner is set large.

Therefore, the present inventors have further conducted researches, and as a result, they have found out that an image having high visibility without glaring is attained by adjusting glossiness of the image.

Then, the present invention has been accomplished by the insight of the present inventors that excellent chroma and excellent visibility are both achieved with a toner, which contains: a noncrystalline resin; and a crystalline resin, wherein the crystalline resin has a weight average molecular weight of 100,000 to 180,000, wherein a temperature range of the toner, within which a loss tangent (tan δ) as measured by a dynamic viscoelasticity measurement is 6 or greater, is 20° C. or greater, and wherein a fixed toner image has 60° glossiness of 30 to 50, where the fixed toner image is obtained by forming an unfixed toner image having a deposition amount of 0.4 mg/cm$^2$ on a recording medium having 60° glossiness of 30 for a measurement, and fixing at temperature at which temperature of the toner image is a lowest temperature of the aforementioned temperature range +10° C., at 0.15 MPa, for a nipping duration of 50 msec.

Note that, a spreading ability of the toner onto a base during heat press fixing is improved by controlling a molecular weight of the noncrystalline resin, and as the noncrystalline resin the molecular weight of which has been controlled is mixed with the crystalline resin that is incompatible to the noncrystalline resin, it is possible to produce an image gloss having further improved visibility without glaring while securing minute surface irregularities, which do not adversely affect chroma of the image surface due to a volume change during cooling of the crystalline resin.

<Noncrystalline Resin>

The noncrystalline resin is appropriately selected depending on the intended purpose without any limitation, provided that it is a resin that is noncrystalline. Examples thereof include a homopolymer of styrene or substitute thereof (e.g., polystyrene, and polyvinyl toluene), a styrene-based copolymer (e.g., a styrene-methyl acrylate copolymer, a styrene-methacrylic acid copolymer, a styrene-methyl methacrylate copolymer, a styrene-butyl methacrylate copolymer, a styrene-acrylonitrile copolymer, a styrene-vinyl methyl ether copolymer, a styrene-vinyl methyl ketone copolymer, a styrene-butadiene copolymer, and a styrene-maleic acid ester copolymer), a polymethyl methacrylate resin, a polybutyl methacrylate resin, a polyvinyl acetate resin, a polyethylene resin, a polyester resin, a polyurethane resin, an epoxy resin, a polyvinyl butyral resin, a polyacrylic acid resin, a rosin resin, a modified rosin resin, and a resin modified to have a functional group reactable with an active hydrogen group.

These may be used alone, or in combination.

Among them, a noncrystalline polyester resin is preferable.

The noncrystalline polyester resin is obtained, for example, allowing polyhydric alcohol and polycarboxylic acid to react.

The polyhydric alcohol is appropriately selected depending on the intended purpose without any limitation, and examples thereof include diol, and trihydric or higher alcohol. Examples of the diol include an ethylene oxide adduct of bisphenol A (bisphenol A-EO adduct), and a propylene oxide adduct of bisphenol A (bisphenol A-PO adduct).

Examples of the polycarboxylic acid include fumaric acid, trimellitic acid, and aromatic polyvalent fatty acid.

The weight average molecular weight of the noncrystalline resin is appropriately selected depending on the intended purpose without any limitation, but the weight average molecular weight thereof is preferably 5,000 to 10,000. When the weight average molecular weight is smaller than 5,000, there may be a problem in heat resistant storage stability of a resulting toner. When the weight average molecular weight is greater then 10,000, achievable glossiness may be low.

The glass transition temperature of the noncrystalline resin is appropriately selected depending on the intended purpose without any limitation, but it is preferably 40° C. to 80° C., more preferably 50° C. to 70° C., and even more preferably 55° C. to 65° C.

An amount of the noncrystalline resin in the toner is appropriately selected depending on the intended purpose without any limitation.

<Crystalline Resin>

The crystalline resin is appropriately selected depending on the intended purpose without any limitation, provided that it is a resin, which has crystallinity. Examples thereof include a polyester resin, a polyurethane resin, a polyurea resin, a polyamide resin, a polyether resin, a vinyl resin, and a modified crystalline resin.

These may be used alone, or in combination.

Among them, preferred are a polyester resin, a polyurethane resin, a polyurea resin, a polyamide resin, and a polyether resin. More preferred is a below-mentioned resin containing a urethane bond, or a urea bond, or both thereof to give humidity resistance and a incompatibility to the noncrystalline resin.

The crystalline resin is preferably incompatacle with the non-crystalline resin.

Whether or not the noncrystalline resin and the crystalline resin are incompatible to each other can be judged with a difference between 1stTg and 2ndTg of a mixed sample.

Specifically, the noncrystalline resin and the crystalline resin are placed in a sample container formed of aluminum at a ratio (mass ratio) of 7:3, the sample container is placed on a holder unit, and then set in an electric furnace.

Subsequently, the sample is heated from 0° C. to 150° C. at the heating rate of 10° C./min in a nitrogen atmosphere. Thereafter, the sample is cooled from 150° C. to 0° C. at the cooling rate of 10° C./min, and then again heated to 150° C. at the heating rate of 10° C./min, to thereby measure a DSC curve using a differential scanning calorimeter (DSC-60, manufactured by Shimadzu Corporation).

The DSC curve for the first heating is selected from the obtained DSC curve using an analysis program in the system of DSC-60, and endothermic shoulder 1stTg of the target sample for the first heating is determined using "endothermic shoulder temperature" in the analysis program. Moreover, the DSC curve for the second heating is selected, and endothermic shoulder 2ndTg of the target sample for the second heating is determined using "endothermic shoulder temperature" in the analysis program. When 1stTg-2ndTg is less than 5° C., it is judged that the noncrystalline resin and the crystalline resin are incompatible to each other. When 1stTg-2ndTg is 5° C. or greater, it is judged that the noncrystalline resin and the crystalline resin are compatible to each other.

Note that, whether or not the noncrystalline resin and the crystalline resin in the toner are incompatible to each other is determined by performing the aforementioned DSC measurement, and judging as being incompatible when "1stTg-2ndTg" is less than 5° C., and as being compatible when "1stTg-2ndTg" is 5° C. or greater.

—Crystalline Polyester Resin—

The crystalline polyester resin is appropriately selected depending on the intended purpose without any limitation, provided that it is a polyester resin having crystallinity. A polyester resin containing a urethane bond, or a urea bond, or both thereof is preferably, as such resin tends to be incompatible to the noncrystalline polyester resin.

—Crystalline Polyester Resin Containing Urethane Bond and/or Urea Bond—

The crystalline polyester resin containing a urethane bond, or a urea bond, or both thereof is appropriately selected depending on the intended purpose without any limitation, but it is preferably a crystalline resin containing a urethane bond, or a urea bond, or both thereof, and a crystalline polyester unit.

A method for obtaining the crystalline resin containing a crystalline polyester unit, and the urethane bond or the urea bond or the both thereof is appropriately selected depending on the intended purpose without any limitation. Examples thereof include: a method (prepolymer method), in which a prepolymer composed of polyurethane units or polyurea units is produced in advance, and the prepolymer is bonded to a crystalline polyester unit having a hydroxyl group at a terminal thereof, which has been separately produced, together to thereby obtain a crystalline resin containing a crystalline polyester unit, and the urethane bond or the urea bond or the both thereof; and a method (one-shot method) in which a crystalline polyester unit having a hydroxyl group at terminal thereof, low molecular weight polyisocyanate, and low molecular weight polyol or polyamine are mixed and allowed to react, to thereby obtain a crystalline resin containing a crystalline polyester unit, and the urethane bond or the urea bond or the both thereof. Among them, the prepolymer method is preferable. In the one-shot method, typically, formation of a polyurethane unit or polyurea unit becomes uneven, and a large unit may not be generated, and therefore crystallinity obstruction of a crystalline polyester unit may be caused. However, at least either a polyurethane unit or a polyurea unit is sufficiently formed by adjusting a reaction temperature, or selecting appropriate monomers. For example, a crystalline resin containing a crystalline polyester unit, and the urethane bond or the urea bond or the both thereof, which has a relatively large polyurea unit, can be obtained in the one-shot method, by using polyamine that has faster reaction speed than the crystalline polyester unit having a hydroxyl group at a terminal thereof for a reaction with isocyanate, to thereby preferentially form a polyurea unit in the initial stage of the reaction, and then carrying out a binding reaction between the crystalline polyester unit and the polyurea unit.

In the prepolymer method, moreover, a polyurethane urea unit, in which a polyurethane unit and a polyurea unit coexist, may be used as a prepolymer.

—Crystalline Polyester Unit—

The crystalline polyester unit is appropriately selected depending on the intended purpose without any limitation, and examples thereof include a polycondensation polyester unit synthesized from polyol and polycarboxylic acid, a lactone ring-opening polymerization product, polyhydroxycarboxylic acid. Among them, a polycondensation polyester unit synthesized from diol and dicarboxylic acid is preferably in view of exhibition of crystallinity.

—Polyol—

Examples of the polyol include diol, and trihydric to octahydric or higher polyol.

The diol is appropriately selected depending on the intended purpose without any limitation, and examples thereof include: aliphatic diol, such as straight-chain aliphatic diol, and branched-chain aliphatic diol; C4-C36 alkylene ether glycol; C4-C36 alicyclic diol; alkylene oxide of the alicyclic diol ("alkylene oxide" may be referred to as "AO" hereinafter); bisphenol AO adduct; polylactone diol; polybutadiene diol; diol containing a carboxyl group; diol containing a sulfonic acid group or a sulfamic acid group; and diol containing another functional group, such as a salt thereof. Among them, aliphatic diol in which a number of carbon atoms in a chain thereof is 2 to 36 is preferable, and straight-chain aliphatic diol in which a number of carbon atoms in a chain thereof is 2 to 36 is more preferable. These may be used alone, or in combination.

An amount of the straight-chain aliphatic diol in the all diols is appropriately selected depending on the intended purpose without any limitation, but the amount thereof is preferably 80 mol % or greater, more preferably 90 mol % or greater. The amount thereof being 80 mol % or greater is advantageous, because crystallinity of a resulting resin improves, both low temperature fixing ability and heat resistant storage stability are desirably achieved, and the resin hardness tends to improve.

The straight-chain aliphatic diol is appropriately selected depending on the intended purpose without any limitation, and examples thereof include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. Among them, preferred are ethylene glycol, 1,3-propanediol, 1,4-butanediol, 1,6-hexanediol, 1,9-nonanediol, and 1,10-decanediol, as they are readily available. Among them, straight-chain aliphatic diol in which a number of carbon atoms in a chain thereof is 2 to 36 is preferable.

The branched-chain aliphatic diol is appropriately selected depending on the intended purpose without any limitation, but it is preferably branched-chain aliphatic diol in which a number of carbon atoms in a chain thereof is 2 to 36. Examples of the branched-chain aliphatic diol include 1,2-propylene glycol, neopentyl glycol, and 2,2-diethyl-1,3-propanediol.

The C4-C36 alkylene ether glycol is appropriately selected depending on the intended purpose without any limitation, and examples thereof include diethylene glycol, triethylene glycol, dipropylene glycol, polyethylene glycol, polypropylene glycol, and polytetramethylene ether glycol.

The C4-C36 alicyclic diol is appropriately selected depending on the intended purpose without any limitation, and examples thereof include 1,4-cyclohexane dimethanol, and hydrogenated bisphenol A.

The alkylene oxide of the alicyclic diol is appropriately selected depending on the intended purpose without any limitation, and examples thereof include an adduct of ethylene oxide (may be abbreviated as EO hereinafter), an adduct of propylene oxide (may be abbreviated as PO hereinafter), and an adduct of butylenes oxide (may be abbreviated as BO hereinafter). Examples of a number of moles added in the adduct include 1 to 30.

The bisphenol AO adduct is appropriately selected depending on the intended purpose without any limitation, and examples thereof include an AO (e.g., EO, PO, and BO) adduct of bisphenol A, bisphenol F, or bisphenol S. Examples of a number of moles added in the adduct include 2 to 30.

The polylactone diol is appropriately selected depending on the intended purpose without any limitation, and examples thereof include poly ϵ-caprolacone diol.

The diol containing a carboxyl group is appropriately selected depending on the intended purpose without any limitation, and examples thereof include dialkylol alkanoic acid. Examples of a number of carbon atoms in the dialkylol alkanoic acid include 6 to 24. Examples of the C6-C24 dialkylol alkanoic acid include 2,2-dimethylol priopionic acid (DMPA), 2,2-dimethylol butanoic acid, 2,2-dimethylol heptanoic acid, and 2,2-dimethylol octanoic acid.

The diol containing a sulfonic acid group or sulfamic acid group is appropriately selected depending on the intended purpose without any limitation, and examples thereof include sulfamic acid diol, N,N-bis(2-hydroxyalkyl)sulfamic acid (a number of carbon atoms in the alkyl group: 1 to 6) AO adduct (e.g., EO and PO, number of moles of AO added: 1 to 6), and bis(2-hydroxyethyl)phosphate.

Examples of the sulfamic acid diol include N,N-bis(2-hydroxyethyl)sulfamic acid, and a N,N-bis(2-hydroxyethyl) sulfamic acid PO (2 mol) adduct.

The neutralized salt group contained in the diol having a neutralized salt group is appropriately selected depending on the intended purpose without any limitation, and examples thereof include C3-C30 tertiary amine (e.g., triethyl amine), and alkali metal (e.g., sodium salt).

Among them, the C2-C12 alkylene glycol, diol having a carboxyl group, an AO adduct of bisphenols, and any combination thereof are preferable.

Moreover, the optional trivalent to octavalent or higher polyol is appropriately selected depending on the intended purpose without any limitation, and examples thereof include: C3-C36 trihydric to octahydric or higher polyhydric aliphatic alcohol; a trisphenol AO adduct (a number of mole added: 2 to 30); a novolak resin AO adduct (a number of moles added: 2 to 30); and acryl polyol, such as a copolymer of hydroxyethyl (meth)acrylate and another vinyl-based monomer.

Examples of the C3-C36 trihydric to octahydric or higher polyhydric aliphatic alcohol include glycerin, trimethylol ethane, trimethylol propane, pentaerythritol, sorbitol, sorbitan, and polyglycerin.

Among them, trihydric to octahydric or higher polyhydric aliphatic alcohol and a novolak resin AO adduct are preferable, and a novolak resin AO adduct is more preferable.

—Polycarboxylic Acid—

Examples of the polycarboxylic acid include dicarboxylic acid, and trivalent to hexavalent or higher polycarboxylic acid.

The dicarboxylic acid is appropriately selected depending on the intended purpose without any limitation, and examples thereof include aliphatic dicarboxylic acid, and aromatic dicarboxylic acid. Examples of the aliphatic dicarboxylic acid include straight-chain aliphatic dicarboxylic acid, and branched-chain aliphatic dicarboxylic acid. Among them, preferred is straight-chain aliphatic dicarboxylic acid.

The aliphatic dicarboxylic acid is appropriately selected depending on the intended purpose without any limitation, and examples thereof include alkane dicarboxylic acid, alkenyl succinic acid, alkene dicarboxylic acid, and alicyclic dicarboxylic acid.

Examples of the alkane dicarboxylic acid include C4-C36 alkane dicarboxylic acid. Examples of the C4-C36 alkane dicarboxylic acid include succinic acid, adipic acid, sebacic acid, azelaic acid, dodecane dicarboxylic acid, octadecane dicarboxylic acid, and decyl succinic acid.

Examples of the alkenyl succinic acid include dodecenyl succinic acid, pentadecenyl succinic acid, and octadecenyl succinic acid.

Examples of the alkene dicarboxylic acid include C4-C36 alkene dicarboxylic acid. Examples of the C4-C36 alkene dicarboxylic acid include maleic acid, fumaric acid, and citraconic acid.

Examples of the alicyclic dicarboxylic acid include C6-C40 alicyclic dicarboxylic acid. Examples of the C6-C40 alicyclic dicarboxylic acid include dimmer acid (e.g., linoeic acid dimer).

The aromatic dicarboxylic acid is appropriately selected depending on the intended purpose without any limitation, and examples thereof include C8-C36 aromatic dicarboxylic acid. Examples of the C8-C36 aromatic dicarboxylic acid include phthalic acid, isophthalic acid, terephthalic acid, t-butylisophthalic acid, 2,6-naphthalene dicarboxylic acid, and 4,4'-biphenyl dicarboxylic acid.

Moreover, examples of the optional trivalent to hexavalent or higher polycarboxylic acid include C9-C20 aromatic polycarboxylic acid. Examples of the C9-C20 aromatic polycarboxylic acid include trimellitic acid, and pyromellitic acid.

Note that, as the dicarboxylic acid or trivalent to hexavalent or higher polycarboxylic acid, acid anhydrides or C1-C4 alkyl ester of the above-listed acids may be used. Examples of the C1-C4 alkyl ester include methyl ester, ethyl ester, and isopropyl ester.

Among the dicarboxylic acid, single use of the aliphatic dicarboxylic acid is preferable, and single use of adipic acid, sebacic acid, dodecanedicarboxylic acid, terephthalic acid, or isophthalic acid is more preferable. Moreover, use of a copolymer of the aliphatic dicarboxylic acid and the aromatic dicarboxylic acid is also preferable. As for the aromatic dicarboxylic acid to be copolymerized, preferred are terephthalic acid, isophthalic acid, t-butylisophthalic acid, and alkyl ester of any of these aromatic dicarboxylic acids. Examples of the alkyl ester include methyl ester, ethyl ester, and isopropyl ester. An amount of the aromatic dicarboxylic acid in the copolymer is preferably 20 mol % or less.

—Lactone Ring-Opening Polymerization Product—

The lactone ring-opening polymerization product is appropriately selected depending on the intended purpose without any limitation, and examples thereof include: a lactone ring-opening polymerization product obtained through a ring-opening polymerization of lactone, such as C3-C12 monolactone (number of ester groups in a ring: one) (e.g., β-propiolactone, γ-butylolactone, δ-valerolactone, and ϵ-caprolactone) with a catalyst (e.g., metal oxide, and an organic metal compound); and a lactone ring-opening polymerization product containing a terminal hydroxy group obtained by subjecting C3-C12 monolactone to ring-opening polymerization using glycol (e.g., ethylene glycol, and diethylene glycol) as an initiator.

The C3-C12 monolactone is appropriately selected depending on the intended purpose without any limitation, but it is preferably ϵ-caprolactone in view of crystallinity.

The lactone ring-opening polymerization product may be selected from commercial products, and examples of the commercial products include highly crystalline polycaprolactone such as H1P, H4, H5, and H17 of PLACCEL series manufactured by Daicel Corporation.

—Polyhydroxycarboxylic Acid—

The preparation method of the polyhydroxycarboxylic acid is appropriately selected depending on the intended purpose without any limitation, and examples thereof include: a method in which hydroxycarboxylic acid such as glycolic acid, and lactic acid (e.g., L-lactic acid, D-lactic acid, and racemic lactic acid) is directly subjected to a dehydration-condensation reaction; and a method in which C4-C12 cyclic ester (the number of ester groups in the ring is 2 to 3), which is an equivalent to a dehydration-condensation product between 2 or 3 molecules of hydroxycarboxylic acid, such as glycolide or lactide (e.g., L-lactide acid, D-lactide, and racemic lactic acid) is subjected to a ring-opening polymerization using a catalyst such as metal oxide and an organic metal compound. The method using ring-opening polymerization is preferable because of easiness in adjusting a molecular weight of the resultant.

Among the cyclic esters listed above, L-lactide and D-lactide are preferable in view of crystallinity. Moreover, terminals of the polyhydroxycarboxylic acid may be modified to have a hydroxyl group or carboxyl group.

—Polyurethane Unit—

Examples of the polyurethane unit include a polyurethane unit synthesized from polyol (e.g., diol, trihydric to octahydric or higher polyol) and polyisocyanate (e.g., diisocyanate, and trivalent or higher polyisocyanate). Among them, preferred is a polyurethane unit synthesized from the diol and the diisocyanate.

As for the polyol, those listed as the polyol in the description of the polyester unit can be used.

—Polyisocyanate—

Examples of the polyisocyanate include diisocyanate, and trivalent or higher polyisocyanate.

The polyisocyanate is appropriately selected depending on the intended purpose without any limitation, and examples thereof include aromatic diisocyanate, aliphatic diisocyanate, alicyclic diisocyanate, and aromatic aliphatic diisocyanate. Among them, preferred are aromatic diisocyanate, in which a number of carbon atoms excluding carbon atoms in the NCO group is 6 to 20, aliphatic diisocyanate, in which the number of the carbon atoms are 2 to 18, alycyclic diisocyanate, in which the number of the carbon atoms are 4 to 15, aromatic aliphatic diisocyanate, in which the number of the carbon atoms are 8 to 15, modified products of these diisocyanates, and a mixture thereof.

Examples of the aromatic diisocyanate include 1,3-phenylene diisocyanate, 1,4-phenylene diisocyanate, 2,4-tolylene diisocyanate (TDI), 2,6-tolylene diisocyanate (TDI), crude TDI, 2,4'-diphenyl methane diisocyanate (MDI), 4,4'-diphenyl methane diisocyanate (MDI), crude MDI, 1,5-naphthylene diisocyanate, 4,4',4"-triphenylmethane triisocyanate, m-isocyanatophenylsulfonyl isocyanate, and p-isocyanatophenylsulfonyl isocyanate.

Examples of the crude MDI include a phosgenated product of crude diaminophenyl methane, and polyacryl polyisocyanate (PAPI). Examples of the crude diaminophenyl methane include a condensation product of formaldehyde and aromatic amine (aniline) or a mixture thereof, and a mixture of diaminodiphenyl methane and a small amount (e.g., 5% by mass to 20% by mass) of trifunctional or higher polyamine.

Examples of the aliphatic diisocyanate include ethylene diisocyanate, tetramethylene diisocyanate, hexamethylene diisocyanate (HDI), dodecamethylene diisocyanate, 1,6,11-undecane triisocyanate, 2,2,4-trimethylhexamethylene diisocyanate, lysine diisocyanate, 2,6-diisocyanatomethylcaproate, bis(2-isocyanatoethyl)fumarate, bis(2-isocyanatoethyl)carbonate, and 2-isocyanatoethyl-2,6-diisocyanatohexanoate.

Examples of the alicyclic diisocyanate include isophorone diisocyanate (IPDI), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, 2,5-norbornanediisocyanate, and 2,6-norbornanediisocyanate.

Examples of the aromatic aliphatic diisocyanate include m-xylene diisocyanate (XDI), p-xylene diisocyanate (XDI), and α,α,α',α'-tetramethylxylene diisocyanate (TMXDI).

Examples of the modified product of the diisocyanate include a modified product containing a urethane group, a modified product containing carbodiimide group, a modified product containing an allophanate group, a modified product containing a urea group, a modified product containing a biuret group, a modified product containing a uretdione group, a modified product containing a uretimine group, a modified product containing an isocyanurate group, and a modified product containing an oxazolidone group. Specific examples thereof include a modified product of diisocyanate (e.g., modified MDI, and urethane-modified TDI) and a mixture thereof. Examples of the modified MDI include urethane-modified MDI, carbodiimide-modified MDI, and trihydrocarbylphosphate-modified MDI. Examples of the mixture include a mixture of modified MDI and urethane-modified TDI (isocyanurate-containing prepolymer).

Among them, preferred are aromatic diisocyanate, in which a number of carbon atoms excluding carbon atoms in the NCO group is 6 to 15, aliphatic diisocyanate, in which the number of the carbon atoms is 4 to 12, and alicyclic diisocyanate, in which the number of the carbon atoms is 4 to 15. More preferred are 2,4-tolylene diisocyanate, 2,6-tolylene diisocyanate, 2,4'-diphenyl methane diisocyanate, 4,4'-diphenyl methane diisocyanate, hexamethylene diisocyanate, dicyclohexylmethane-4,4'-diisocyanate, and isophorone diisocyanate.

—Polyurea Unit—

Examples of the polyurea unit include a polyurea unit synthesized from polyamine (e.g., diamine, and trivalent or higher polyamine), and polyisocyanate (e.g., diisocyanate, and trivalent or higher polyisocyanate).

—Polyamine—

The polyamine is appropriately selected depending on the intended purpose without any limitation, and examples thereof include aliphatic diamine, and aromatic diamine. Among them, C2-C18 aliphatic diamine, and C6-C20 aromatic diamine are preferable. Moreover, trivalent or higher amine may be used optionally.

Examples of the C2-C18 aliphatic diamine include C2-C6 alkylene diamine, a C1-C4 alkyl or C2-C4 hydroxyalkyl substitution product thereof, alicyclic or heterocyclic aliphatic diamine, and C8-C15 aromatic ring-containing aliphatic amine.

Examples of the C2-C6 alkylene diamine include ethylene diamine, propylene diamine, trimethylene diamine, tetramethylene diamine, and hexamethylene diamine.

Examples of the C1-C4 alkyl or C2-C4 hydroxyalkyl substitution product include dialkylaminopropylamine, trimethylhexamethylene diamine, aminoethylethanolamine, 2,5-dimethyl-2,5-hexamethylene diamine, and methyl isobispropyl amine.

Examples of the alicyclic or heterocyclic aliphatic diamine include C4-C15 alicyclic diamine, and C4-C15 heterocyclic diamine. Examples of the C4-C15 alicyclic diamine include 1,3-diaminocyclohexane, isophorone diamine, methane diamine, and 4,4'-methylene dichloroanilinehexane diamine (hydrogenated methylene dianiline). Examples of the C4-C15 heterocyclic diamine include piperazine, N-aminoethyl piperazine, 1,4-diaminoethyl piperazine, 1,4-bis(2-amino-2-methylpropyl)piperazine, and 3,9-bis(3-aminopropyl)-2,4,8,10-tetraoxapiro[5,5]undecane.

Examples of the C8-C15 aromatic ring-containing aliphatic amine include xylylene diamine, and tetrachloroaniline-p-xylylene diamine.

Examples of the C6-C20 aromatic diamine include non-substituted aromatic diamine, aromatic diamine having a C1-C4 nuclear-substituted alkyl group, a mixture of isomers of the above-listed non-substituted aromatic diamine and/or aromatic diamine having C1-C4 nuclear-substituted alkyl group with various blending ratios, aromatic diamine having a nuclear-substituted electron-withdrawing group, and aromatic diamine having a secondary amino group.

Examples of the non-substituted aromatic diamine include 1,2-phenylene diamine, 1,3-phenylene diamine, 1,4-phenylene diamine, 2,4'-diphenyl methane diamine, 4,4'-diphenyl methane diamine, crude diphenyl methane diamine (polyphenyl polymethylene polyamine), diamine diphenyl sulfone, benzidine, thiodianiline, bis(3,4-diaminephenyl)sulfone, 2,6-diamine pyridine, m-aminobenzyl amine, triphenylmethane-4,4',4"-triamine, and naphthylene diamine.

Examples of the aromatic diamine having a C1-C4 nuclear-substituted alkyl group include 2,4-tolylene diamine, 2,6-tolylene diamine, crude tolylene diamine, diethyltolylene diamine, 4,4'-diamine-3,3'-dimethyldiphenyl methane, 4,4'-bis(o-toluidine), dianisidine, diamine ditolylsulfone, 1,3-dimethyl-2,4-diamine benzene, 1,3-dimethyl-2,6-diamine benzene, 1,4-diisopropyl-2,5-diamine benzene, 2,4-diamine mesitylene, 1-methyl-3,5-diethyl-2,4-diamine benzene, 2,3-dimethyl-1,4-diamine naphthalene, 2,6-dimethyl-1,5-diamine naphthalene, 3,3',5,5'-tetramethylbenzidine, 3,3',5,5'-tetramethyl-4,4'-diamine diphenyl methane, 3,5-diethyl-3'-methyl-2',4-diamine diphenyl methane, 3,3'-diethyl-2,2'-diamine diphenyl methane, 4,4'-diamine-3,3'-dimethyl diphenyl methane, 3,3',5,5'-tetraethyl-4,4'-diamine benzophenone, 3,3',5,5'-tetraethyl-4,4'-diamine diphenyl ether, and 3,3',5,5'-tetraisopropyl-4,4'-diamine diphenyl sulfone.

Examples of the nuclear-substituted electron-withdrawing group in the aromatic diamine having a nuclear-substituted electron-withdrawing group include halogen, an alkoxy group, and a nitro group. Examples of the halogen include Cl, Br, I, and F. Examples of the alkoxy group include a methoxy group, and an ethoxy group. Examples of the aromatic diamine having a nuclear-substituted electron-withdrawing group include methylene bis-o-chloroaniline, 4-chloro-o-phenylene diamine, 2-chloro-1,4-phenylene diamine, 3-amino-4-chloroaniline, 4-bromo-1,3-phenylene diamine, 2,5-dichloro-1,4-phenylene diamine, 5-nitro-1,3-phenylene diamine, 3-dimethoxy-4-aminoaniline; 4,4'-diamine-3,3'-dimethyl-5,5'-dibromo-diphenyl methane, 3,3'-dichloroanilinebenzidine, 3,3'-dimethoxybenzidine, bis(4-amino-3-chloroanilinephenyl)oxide, bis(4-amino-2-chloroanilinephenyl)propane, bis(4-amino-2-chloroanilinephenyl)sulfone, bis(4-amino-3-methoxyphenyl)decane, bis(4-aminophenyl)sulfide, bis(4-aminophenyl)telluride, bis(4-aminophenyl)selenide, bis(4-amino-3-methoxyphenyl)disulfide, 4,4'-methylenebis(2-iodoaniline), 4,4'-methylenebis(2-bromoaniline), 4,4'-methylenebis(2-fluoroaniline), and 4-aminophenyl-2-chloroaniline.

Examples of the aromatic diamine having a secondary amino group include aromatic diamine, in which part of or entire primary amino groups in the non-substituted aromatic diamine, the aromatic diamine having C1-C4 nuclear-substituted alkyl group, the mixture of isomers thereof with various blending ratios, and aromatic diamine having a nuclear-substituted electron-withdrawing group are replaced with secondary amino groups by substitution with a lower alkyl group (e.g., a methyl group, and an ethyl group).

Examples of the trivalent or higher amine include polyamide polyamine, and a polyether polyamine.

Examples of the polyamide polyamine include a low molecular polyamide polyamine obtained through a condensation of dicarboxylic acid with an excess amount (2 mol or greater per 1 mol of acid) of polyamine. Examples of the dicarboxylic acid include dimmer acid. Examples of the polyamine include alkylene diamine, and polyalkylene polyamine.

Examples of the polyether polyamine include a hydrogenated compound of cyanoethylated polyether polyol. Examples of the polyether polyol include polyalkylene glycol.

The weight average molecular weight of the crystalline resin is 100,000 to 180,000. When the weight average molecular weight is smaller than 100,000, the crystalline resin has high compatibility to the noncrystalline resin during pressure heat fixing at high temperature, and as a result, an effect of suppressing glossiness of a formed image is impaired to thereby produce the image having glaring and undesirable visibility. When the weight average molecular weight is greater than 180,000, dispersibility of the noncrystalline resin becomes low to thereby present as large domains in a toner particle, and therefore a resulting image increases diffuse light to thereby lower the image chroma.

A melting point of the crystalline resin is appropriately selected depending on the intended purpose without any limitation, but the melting point thereof is preferably 50° C. to 110° C., more preferably 60° C. to 90° C., and even more preferably 65° C. to 80° C. When the melting point is lower than 50° C., heat resistant storage stability of a resulting toner may be insufficient. When the melting point is greater than 110° C., an effect for improving low fixing ability may be low.

A mass ratio (noncrystalline resin/crystalline resin) of the noncrystalline resin to the crystalline resin is appropriately selected depending on the intended purpose without any limitation, but the mass ratio is preferably 80/20 to 70/30. When the ratio of the crystalline resin is less than 80/20 in the mass ratio, suppression of glaring of an image may not be sufficient. When the ratio thereof is greater than 70/30, diffuse light, which is considered to be caused by the crystalline resin, may adversely affect chroma.

Moreover, it is preferred that the toner contain the noncrystalline resin having the weight average molecular weight of 5,000 to 10,000, and the crystalline resin having the weight average molecular weight of 100,000 to 180,000. Use of such noncrystalline resin and crystalline resin further improve spreading of a resulting toner during fixing due to the noncrystalline resin, and also reduces glaring of a resulting image due to the crystalline resin, without reducing chroma.

<Other Components>

Other components are appropriately selected depending on the intended purpose without any limitation, and examples thereof include a colorant, a releasing agent, a charge controlling agent, and external additives.

—Colorant—

The colorant is appropriately selected depending on the intended purpose without any limitation, and examples thereof include a black pigment, a yellow pigment, a magenta pigment, and cyan pigment. Among them, the toner preferably contain at least one selected from the group consisting of a yellow pigment, a magenta pigment, and a cyan pigment.

The black pigment is, for example, used for a black toner. Examples of the black pigment include carbon black, copper oxide, manganese dioxide, aniline black, activated carbon, nonmagnetic ferrite, magnetite, a nigrosin dye, and black iron oxide.

The yellow pigment is, for example, used for a yellow toner. Examples of the yellow pigment include C.I. Pigment Yellow 74, 93, 97, 109, 128, 151, 154, 155, 166, 168, 180, 185, Naphthol Yellow S, Hansa Yellow (10G, 5G, G), cadmium yellow, yellow iron oxide, yellow ocher, chrome yellow, Titan Yellow, and Polyazo Yellow.

The magenta pigment is, for example, used for a magenta toner. Examples of the magenta pigment include a quinacridon-based pigment, and a monoazo pigment, such as C.I. Pigment Red 48:2, 57:1, 58:2, 5, 31, 146, 147, 150, 176, 184, and 269. Moreover, the monoazo pigment may be used in combination with the quinacridon-based pigment.

The cyan pigment is, for example, used for a cyan toner. Examples of the cyan pigment include a Cu-phthalocyanine pigment, a Zn-phthalocyanine pigment, and an Al-phthalocyanine pigment.

These may be used alone, or in combination.

As for the black pigment, carbon black is preferable.

As for the cyan pigment, C.I. Pigment Blue 15:3 is preferable.

As for the magenta pigment, C.I. Pigment Red 122, C.I. Pigment Red 269, and C.I. Pigment Red 81:4 are preferable.

As for the yellow pigment, C.I. Pigment Yellow 74, C.I. Pigment Yellow 155, C.I. Pigment Yellow 180, and C.I. Pigment Yellow 185 are preferable.

The black pigment is particularly preferably carbon black in view of hue, and keeping quality of an image.

The cyan pigment is particularly preferably C.I. Pigment Blue 15:3 in view of hue, and keeping quality of an image.

The magenta pigment is particularly preferably a mixture of C.I. Pigment Red 122, and C.I. Pigment Red 269 in view of hue, and keeping quality of an image.

The yellow pigment is particularly preferably C.I. Pigment Yellow 185 in view of hue, and keeping quality of an image.

An amount of the colorant is appropriately selected depending on the intended purpose without any limitation, but the amount thereof is preferably 3 parts by mass to 12 parts by mass, more preferably 5 parts by mass to 10 parts by mass, relative to 100 parts by mass of the toner. When the amount thereof is smaller than 3 parts by mass, the coloring ability of the toner may be insufficient. When the amount thereof is greater than 12 parts by mass, the pigment may cause dispersion failures in the toner, which may lead to low coloring ability, and undesirable electric property of the toner.

The colorant may be used as a master batch, in which the colorant forms a composite with a resin. The resin used for the production of the master batch, or the resin kneaded with the master batch is appropriately selected depending on the intended purpose without any limitation.

The master batch can be obtained by mixing a resin for a master batch with the colorant upon application of high shearing force, and kneading the mixture. Preferably, an organic solvent may be used for improving the interactions between the colorant and the resin. Further, a so-called flashing method is preferably used, since a wet cake of the colorant can be directly used, i.e., no drying is required. Here, the flashing method is a method in which an aqueous paste containing a colorant is mixed or kneaded with a resin and an organic solvent, and then the colorant is transferred to the resin to remove the water and the organic solvent. In this mixing or kneading, a high-shearing disperser (e.g., a three-roll mill) is preferably used.

—Releasing Agent—

The releasing agent is appropriately selected depending on the intended purpose without any limitation, and examples thereof include carbonyl group-containing wax, polyolefin wax, and long chain hydrocarbon. These may be used alone, or in combination. Among them carbonyl group-containing wax is preferable.

Examples of the carbonyl group-containing wax include polyalkanoic acid ester, polyalkanol ester, polyalkanoic acid amide, polyalkyl amide, and dialkyl ketone.

Examples of the polyalkanoic acid ester include carnauba wax, montan wax, trimethylolpropane tribehenate, pentaerythritol tetrabehenate, pentaerythritol diacetate dibehenate, glycerin tribehenate, and 1,18-octadecanediol distearate.

Examples of the polyalkanol ester include tristearyl trimellitate, and distearyl maleate.

Examples of the polyalkanoic acid amide include dibehenyl amide.

Examples of the polyalkyl amide include trimellitic acid tristearyl amide.

Examples of the dialkyl ketone include distearyl ketone.

Among the carbonyl group-containing wax mentioned above, polyalkanoic acid ester is particularly preferable.

Examples of the polyolefin wax include polyethylene wax, and polypropylene wax.

Examples of the long chain hydrocarbon include paraffin wax, and sasol wax.

A melting point of the releasing agent is appropriately selected depending on the intended purpose without any limitation, but the melting point thereof is preferably 50° C. to 120° C., more preferably 60° C. to 90° C. When the melting point is lower than 50° C., use of such releasing agent may adversely affect the heat resistant storage stability of the resulting toner. When the melting point is greater than 120° C., the resulting toner is likely to cause cold offset during the fixing at low temperature.

The melting point can be determined, for example, by measuring the maximum endothermic peak by means of a differential scanning calorimeter, TG-DSC System TAS-100 (manufactured by Rigaku Corporation).

An amount of the releasing agent is appropriately selected depending on the intended purpose without any limitation, but the amount thereof is preferably 1 part by mass to 20 parts by mass, more preferably 3 parts by mass to 10 parts by mass, relative to 100 parts by mass of the toner. When the amount thereof is smaller than 1 part by mass, a resulting toner may have low hot offset resistance and insufficient low temperature fixing ability. When the amount thereof is greater than 20 parts by mass, a resulting toner may have low transfer ability and resistance.

—Charge Controlling Agent—

The charge controlling agent is appropriately selected depending on the intended purpose without any limitation, and examples thereof include nigrosin-based dye, a triphenyl methane-based dye, a chromium-containing metal complex dye, a molybdic acid chelate pigment, a rhodamine-based dye, alkoxy amine, quaternary ammonium salt (including fluorine-modified quaternary ammonium salt), alkyl amide, phosphorus or a phosphorus compound, tungsten or a tungsten compound, a fluorine-based active agent, a metal salt of salicylic acid, and a metal salt of a salicylic acid derivative. Specific examples include: a nigrosin-based dye BONTRON 03, a quaternary ammonium salt BONTRON P-51, metal-containing azo dye BONTRON S-34, oxynaphthoic acid-based metal complex E-82, salicylic acid-based metal complex E-84 and phenol condensate E-89 (all manufactured by ORIENT CHEMICAL INDUSTRIES CO., LTD.); a quaternary ammonium salt molybdenum complex TP-302, and TP-415 (both manufactured by Hodogaya Chemical Co., Ltd.); and LRA-901, and a boron complex LR-147 (both manufactured by Japan Carlit Co., Ltd.). These may be used alone, or in combination.

An amount of the charge controlling agent is appropriately selected depending on the intended purpose without any limitation, but the amount thereof is preferably 0.1 parts by mass to 10 parts by mass, more preferably 0.2 parts by mass to 5 parts by mass, relative to 100 parts by mass of the toner. When the amount thereof is smaller than 0.1 parts by mass, a quality of a resulting toner image may be low, as the speed of charging up, and the amount of the charge are not sufficient. When the amount thereof is greater than 10 parts by mass, electrostatic suction force between with a developing roller increases, as charging ability of a resulting toner is excessive, and therefore reduction in flowability of a developer, or in an image density may be caused.

—External Additives—

The external additives are appropriately selected depending on the intended purpose without any limitation, and examples thereof include silica, fatty acid metal salt, metal oxide, hydrophobing treated titanium oxide, and a fluoropolymer.

Examples of the fatty acid metal salt include zinc stearate, and aluminum stearate.

Examples of the metal oxide include titanium oxide, aluminum oxide, tin oxide, and antimony oxide.

Examples of a commercial product of the silica include R972, R974, RX200, RY200, R202, R805, and R812 (all manufactured by Nippon Aerosil Co., Ltd.).

Examples of a commercial product of the titanium oxide include: P-25 (manufactured by Nippon Aerosil Co., Ltd.); STT-30, STT-65C-S (both manufactured by Titan Kogyo, Ltd.); TAF-140 (manufactured by Fuji Titanium Industry Co., Ltd.); and MT-150W, MT-500B, MT-600B, MT-150A (all manufactured by TAYCA CORPORATION).

Examples of a commercial product of the hydrophobing treated titanium oxide include: T-805 (manufactured by Nippon Aerosil Co., Ltd.); STT-30A, STT-65S-S (both manufactured by Titan Kogyo, Ltd.); TAF-500T, TAF-1500T (both manufactured by Fuji Titanium Industry Co., Ltd.); MT-100S, MT-100T (both manufactured by TAYCA CORPORATION); and IT-S (manufactured by ISHIHARA SANGYO KAISHA, LTD.).

A method of the hydrophobing treatment include a method for treating hydrophilic particles with a silane coupling agent, such as methyltrimethoxy silane, methyltriethoxy silane, and octyltrimethoxy silane.

An amount of the external additives is appropriately selected depending on the intended purpose without any limitation, but the amount thereof is preferably 0.1 parts by mass to 5 parts by mass, more preferably 0.3 parts by mass to 3 parts by mass, relative to 100 parts by mass of the toner.

The average particle diameter of primary particles of the external additives is appropriately selected depending on the intended purpose without any limitation, but the average particle diameter thereof is preferably 1 nm to 100 nm, more preferably 3 nm to 70 nm. When the average particle diameter thereof is smaller than 1 nm, the external additives may be embedded in a toner particles, and therefore a function of the external additive may not be effectively exhibited. When the average particle diameter thereof is greater than 100 nm, the external additive may unevenly damage a surface of a photoconductor.

The toner has a temperature region of 20° C. or more, within which loss tangent (tan δ) as measured by a dynamic viscoelasticity measurement is 6 or greater.

The loss tangent (tan δ) is calculated by [loss elastic modulus G"/storage elastic modulus G'], and is a value indicating an energy amount absorbed when a material is deformed. The larger the loss tangent (tan δ) is, more excellent spreading ability of a toner during pressure heat fixing.

Moreover, the fact that the toner has a temperature region of 20° C. or more, within which loss tangent (tan δ) as measured by a dynamic viscoelasticity measurement is 6 or greater means that the spreading ability of the toner is excellent.

The upper limit of the temperature region is appropriately selected depending on the intended purpose without any limitation, but the temperature region is preferably 150° C. or lower.

The temperature region, within which the loss tangent (tan δ) is 6 or greater, is preferably in the range of 90° C. to 150° C. in view of energy saving owing to reduced fixing temperature. When the temperature region is in the aforementioned range, a selection of a releasing agent for use becomes easier.

Using the toner, a fixed toner image has 60° glossiness of 30 to 50, where the fixed toner image is obtained by forming an unfixed toner image on a recording medium having 60° glossiness of 30 for measurement with a deposition amount of 0.4 mg/cm$^2$, and fixing the toner image at the temperature at which temperature of the toner image is the lowest temperature of the aforementioned temperature range +10° C., at 0.15 MPa, for a nipping duration of 50 msec. As a result of this, an image having excellent gloss and excellent visibility can be obtained. When the glossiness is less than 30, a high quality image cannot be achieved, as gloss is low. When the glossiness is greater than 50, visibility of an image reduces, as glaring of the image appears.

A recording medium having 60° glossiness of 30 for measurement is used in the measurement of the 60° glossiness. This is to remove an influence of a fixed image state due to a surface configuration of the recording medium for measurement over the glossiness to be measured.

In the measurement of the 60° glossiness, an unfixed solid image is formed with a deposition amount of 0.4 mg/cm$^2$. This is based on an assumption of a deposition amount of a typical solid image in image formation with a toner.

In the measurement of the 60° glossiness, the toner image is fixed at the temperature at which temperature of the toner image is the lowest temperature of the aforementioned temperature region +10° C. at 0.15 MPa, for a nipping duration of 50 msec. This is because these conditions are suitable conditions for assuming image formation performed in an actual device.

The 60° glossiness can be measured, for example, by means of a glossmeter (VG7000, manufactured by Nippon Denshoku Industries Co., Ltd.).

Examples of the recording medium for measurement include POD gloss coat (manufactured by Oji Paper Co., Ltd., 60° glossiness: 30).

The volume median diameter (D50) of the toner is appropriately selected depending on the intended purpose without any limitation, but it is preferably 3.0 μm to 8.0 μm, more preferably 4.0 μm to 7.0 μm.

The volume median diameter (D50) can be measured, for example, by means of Coulter Counter TA-II, or Coulter Multisizer II (both manufactured by Beckman Coulter Inc.).

<Weight Average Molecular Weight>

The weight average molecular weight can be measured, for example, by means of a gel permeation chromatography (GPC) measuring device (e.g., GPC-8220GPC of Tosoh Corporation). As for a column, for example, TSKgel Super HZM-H, 15 cm, three connected columns (of Tosoh Corporation) are used. The resin to be measured is formed into a 0.15% by mass solution using tetrahydrofuran (THF) (containing a stabilizer, manufactured by Wako Chemical Industries, Ltd.). After filtering the resulting solution with a filter having a pore size of 0.2 μm, the filtrate is provided as a sample. The obtained sample is injected in an amount of 100 μL into the measuring device, and the measurement is carried out at a flow rate of 0.45 mL/min in the environment having the temperature of 40° C. For the measurement of the molecular weight of the sample, a molecular weight of the sample is calculated from the relationship between the logarithmic value of the calibration curve prepared from a several monodisperse polystyrene standard samples and the number of counts. As for the monodisperse polystyrene standard sample, Showdex STANDARD Std. Nos. S-7300, S-210, S-390, S-875, S-1980, S-10.9, S-629, S-3.0, and S-0.580 of SHOWA DENKO K.K., and toluene are used. As the detector, a refractive index (RI) detector is used.

<Volume Median Diameter (D50)>

A measuring method of the volume median diameter is explained.

First, 0.1 mL to 5 mL of a surfactant (preferably alkyl benzene sulfonate) is added as a dispersant to 100 mL to 150 mL of an electrolyte.

Note that, the electrolyte is an about 1% by mass NaCl aqueous solution prepared by using grade-1 sodium chloride, and for example, ISOTON-II (of Beckman Coulter, Inc.) is used as the electrolyte.

Next, to the resulting mixture, 2 mg to 20 mg of a sample is added.

The electrolyte in which the sample has been suspended is dispersed by means of an ultrasonic wave disperser for about 1 minute to about 3 minutes. The volume and number of the toner particles are measured from the obtained dispersion liquid using the aforementioned measuring device with an aperture of 100 μm.

Note that, as a channel, the following 13 channels are used: 2.00 μm or larger, but smaller than 2.52 μm; 2.52 μm or larger, but smaller than 3.17 μm; 3.17 μm or larger, but smaller than 4.00 μm; 4.00 μm or larger, but smaller than 5.04 μm; 5.04 μm or larger, but smaller than 6.35 μm; 6.35 μm or larger, but smaller than 8.00 μm; 8.00 μm or larger, but smaller than 10.08 μm; 10.08 μm or larger, but smaller than 12.70 μm; 12.70 μm or larger, but smaller than 16.00 μm; 16.00 μm or larger, but smaller than 20.20 μm; 20.20 μm or larger, but smaller than 25.40 μm; 25.40 μm or larger, but smaller than 32.00 μm; and 32.00 μm or larger, but smaller than 40.30 μm. The target particles for the measurement are particles having the diameters of 2.00 μm or larger, but smaller than 40.30 μm.

<Production Method of Toner>

A production method of the toner is appropriately selected depending on the intended purpose without any limitation, and examples thereof include a pulverization method, and a polymerization method.

Examples of the pulverization method include a method containing (1) kneading a toner composition (kneading step), (2) pulverizing the kneaded toner composition (pulverizing step), and (3) classifying the pulverized product into a certain particle diameter (classifying step).

Examples of the toner composition include a composition containing the noncrystalline resin, the crystalline resin, and the colorant.

Examples of the kneader used in the kneading step include a sealed kneader, a single or twin screw extruder, and an open roll kneader. Specific examples thereof include: a KRC kneader (manufactured by Lurimoto, Ltd.); Buss Cokneader (manufactured by Buss A.G.); a TEM extruder (manufactured by Toshiba Machine Co., Ltd.); a TEX twin screw kneader (manufactured by The Japan Steel Works, Ltd.); a PCM kneader (manufactured by Ikegai, Ltd.); a three-roll mill, a mixing roll mill, and a kneader (all manufactured by Inoue Mfg. Inc.); Kneadex (manufactured by Nippon Cole & Engineering Co., Ltd.); a MS-type pressure kneader, and a kneader-ruder (both manufactured by Moriyama Company, Ltd.); and Banbury Mixer (manufactured by Kobe Steel, Ltd.).

The pulverizer used in the pulverizing step is appropriately selected depending on the intended purpose without any limitation. As for the pulverizer, a commercial product can be used. Examples of the commercial product thereof include: a counter jet mill, micron jet, and inomizer (all manufactured by Hosokawa Micron Corporation); IDS mill, and PJM jet pulverizer (all manufactured by Nippon Pneumatic Mfg. Co., Ltd.); a cross jet mill (manufactured by Kurimoto, Ltd.); Ulmax (manufactured by Nisso Engineering Co., Ltd.); SK Jet-O-Mill (manufactured by Seishin Enterprise Co., Ltd.); Cliptron (manufactured by Kawasaki Heavy Industries, Ltd.); Turbo Mill (manufactured by Turbo Kogyo Co., Ltd.); and Super Rotor (manufactured by Nisshin Engineering Inc.).

The classifier used in the classifying step is appropriately selected depending on the intended purpose without any limitation. As for the classifier, a commercial product can be used. Examples of the commercial product thereof include: Classiel, Micron Classifier, and Specific Classifier (all manufactured by Seishin Enterprise Co., Ltd.); Turbo Classifier (manufactured by Nisshin Engineering Inc.); Micron Separator, Turboplex (ATP), and TSP Separator (all manufactured by Hosokawa Micron Corporation); Elbow-jet (manufactured by Nittetsu Mining Co., Ltd.); Dispersion Separator (manufactured by Nippon Pneumatic Mfg. Co., Ltd.); and YM Microcut (manufactured by Uras Techno Co., Ltd.).

(Two-Component Developer)

The two-component developer of the present invention contains at least the toner of the present invention, and a carrier, and may further contain other components according to the necessity.

<Carrier>

The carrier is appropriately selected depending on the intended purpose without any limitation, but the carrier is preferably a carrier, containing carrier particles each of which include a core material, and a resin layer coating the core material.

—Core Material—

The core material is appropriately selected depending on the intended purpose without any limitation, provided that it is a particle having magneticity. The core material is preferably ferrite, magnetite, iron, or nickel. Considering environmental adaptability, which has been recently significantly concerned, as for the ferrite, preferred are, not a conventional Cu—Zn based ferrite, but manganese ferrite, manganese-magnesium ferrite, manganese-strontium ferrite, manganese-magnesium-strontium ferrite, and lithium-based ferrite.

—Resin Layer—

A material of the resin layer is appropriately selected depending on the intended purpose without any limitation, and examples thereof include an amino-based resin, a polyvinyl-based resin, a polystyrene-based resin, a halogenated olefin resin, a polyester-based resin, a polycarbonate-based resin, a polyethylene resin, a polyvinyl fluoride resin, a polyvinylidene fluoride resin, a polytrifluoroethylene resin, a polyhexafluoropropylene resin, a copolymer of vinylidene fluoride and an acryl monomer, a copolymer of vinylidene fluoride and vinyl fluoride, a terpolymer of tetrafluoroethylene, vinylidene fluoride, and non-fluoro monomer, and a silicone resin. These may be used alone, or in combination.

The silicone resin is appropriately selected depending on the intended purpose without any limitation, and examples thereof include: a straight silicone resin composed only of organosiloxane bonds; and a modified silicone resin, which has been modified with an alkyd resin, a polyester resin, an epoxy resin, an acryl resin, or a urethane resin.

As for the silicone resin, a commercial product can be used.

Examples of the straight silicone resin include: KR271, KR255, and KR152, manufactured by Shin-Etsu Chemical Co., Ltd.; and SR2400, SR2406, and SR2410, manufactured by Dow Corning Toray Co., Ltd.

Examples of the modified silicone resin include: KR206 (alkyd-modified resin), KR5208 (acryl-modified silicone resin), ES1001N (epoxy-modified silicone resin), and KR305 (urethane-modified silicone resin), manufactured by Shin-Etsu Chemical Co., Ltd.; and SR2115 (epoxy-modified silicone resin), and SR2110 (alkyd-modified silicone resin) manufactured by Dow Corning Toray Co., Ltd.

Note that, it is possible to use the silicone resin alone, but it is also possible to use the silicone resin in combination with a component that proceeds a crosslink reaction, or a component for adjusting a charging amount.

An amount of the component(s) for forming the resin layer in the carrier is preferably 0.01% by mass to 5.0% by mass. When the amount thereof is smaller than 0.01% by mass, the resin layer may not be uniformly formed on a surface of the core material. When the amount thereof is greater than 5.0% by mass, the resin layer becomes excessively thick, and therefore carrier particles are aggregated together to form a particle, and uniform carrier particles may not be attained.

In the case where the developer is a two-component developer, an amount of the toner is appropriately selected depending on the intended purpose without any limitation, but the amount of the toner is preferably 2.0 parts by mass to 12.0 parts by mass, more preferably 2.5 parts by mass to 10.0 parts by mass, relative to 100 parts by mass of the carrier.

(Toner Set)

The toner set of the present invention contains a first toner, and a second toner, and may further contain other toners according to the necessity.

The first toner is the toner of the present invention, which contains a first colorant.

The second toner is the toner of the present invention, which contains a second colorant which is in a different color from the first colorant.

Examples of the first toner include a cyan toner, a magenta toner, and a yellow toner. Among them, a cyan toner is preferable.

Examples of the second toner include a cyan toner, a magenta toner, and a yellow toner. Among them, a yellow toner is preferable.

The first colorant and the second colorant are appropriately selected depending on the intended purpose without any limitation, and examples thereof include the colorants listed in the descriptions of the toner of the present invention.

(Toner Container)

The toner container of the present invention contains a container housing the toner of the present invention therein.

The toner container is appropriately selected from those known in the art without any limitation, and examples thereof include a toner container containing a container main body and a cap.

A shape of the toner container main body is appropriately selected depending on the intended purpose without any limitation, but it is preferably a cylinder, and is more preferably a shape where recess is spirally formed in the internal circumference surface to thereby enable the content, which is the toner, to move to the side of the outlet by rotation of the container main body, and the part of or entire spiral recess section functions as bellows.

A material of the toner container main body is appropriately selected depending on the intended purpose without any limitation, but it is preferably a material that is excellent in dimensional accuracy on the production, more preferably a resin. Examples of the resin include a polyester resin, a polyethylene resin, a polypropylene resin, a polystyrene resin, a polyvinyl chloride resin, polyacrylic acid, a polycarbonate resin, an ABS resin, and a polyacetal resin.

(Printed Matter)

[First Printed Matter]

The first printed matter of the present invention contains at least a recording medium, and a fixed toner image, and may further contain other members according to the necessity.

The fixed toner image is formed on the recording medium.

The fixed toner image is formed of the toner of the present invention.

[Second Printed Matter]

The second printed matter of the present invention contains at least a recording medium, and a fixed toner image of secondary color, and may further contain other members according to the necessity.

The fixed toner image is formed on the recording medium.

The fixed toner image is formed with a first toner, which is the toner of the present invention containing a first colorant, and a second toner, which is the toner of the present invention containing a second colorant that is in a color different from a color of the first colorant.

The brightness standard deviation $\sigma r$ of the fixed toner image is less than 4.0.

The 60° glossiness of the fixed toner image is 30 to 50.

[Third Printed Matter]

The third printed matter of the present invention contains at least a recording medium, and a fixed toner image of secondary color, and may further contain other members according to the necessity.

The fixed toner image is formed on the recording medium.

The brightness standard deviation σr of the fixed toner image is less than 4.0.

The 60° glossiness of the fixed toner image is 30 to 50.

In a conventional electrophotographic system, spreading of a lower layer toner (at a side of a recording medium) is insufficient during fixing, as a secondary color image, such as RGB, which is realized by laminating a plurality of process color toners on the recording medium, is output. Therefore, chroma of secondary color is significantly low, in the state where the recording medium is not sufficiently covered, and the toner is locally present.

The present inventors have found out from the researched conducted thereby that it is important to make a loss tangent (tan δ) as measured by dynamic viscoelasticity measurement of the toner large, in order to secure spreading ability of the lower layer toner, during formation of a secondary color image.

Moreover, it is also found out that high chroma is achieved by increasing tan δ of the toner, but such toner result an image of low visibility.

Therefore, the present inventors further conducted researches. As a result, it was found out that an image having high visibility without glaring can be attained by adjusting glossiness of the image.

The second printed matter, and the third printed matter can achieve both excellent chroma and excellent visibility, as the brightness standard deviation σr of the fixed toner image is less than 4.0, and the glossiness is 30 to 50.

The brightness standard deviation σr indicates a masking ability of the lower layer toner (the degree of the lower toner masking the recording medium) in a fixed toner image of secondary color. Specifically, it is assumed that the brightness standard deviation σr is related to spreading ability of the lower layer toner.

The brightness standard deviation σr is less than 4.0, preferably less than 3.5. When the brightness standard deviation σr is 4.0 or greater, spreading of the lower layer toner on a recording medium is insufficient, and as a result chroma becomes low.

The brightness standard deviation σr can be determined by the following method.

A dark field image of the formed secondary color image is taken by means of a scanning system including a system microscope BX51 for researches (manufactured by Olympus Corporation, magnification of objective lens: ×10) and Magnafire (manufactured by Optronics, pixel: 1280×1024).

A channel, which is to be an absorption band range of the lower layer toner, is extracted from the obtained RGB image. (the lower layer toner being cyan→R, channel, the lower layer tone being magenta→G channel, the lower layer toner being yellow→B channel)

The standard deviation of the value of the brightness of the extracted channel is calculated.

The measurement is performed on three positions, and the average value thereof is determined as brightness standard deviation σr.

An image having desirable gloss and excellent visibility is achieved with the second printed matter, and the third printed matter, as the 60° glossiness thereof is 30 to 50. When the 60° glossiness is less than 30, gloss is insufficient and chroma is low. When the 60° glossiness is greater than 50, visibility is low. The 60° glossiness is more preferably 30 to 40, as one of the conditions for giving excellent visibility is that the glossiness thereof is close to the glossiness of the recording medium.

The recording medium in the first printed matter, the second printed matter, or the third printed matter is appropriately selected depending on the intended purpose without any limitation, and examples thereof include paper, cloth, and a sheet for over head projectors (OHP).

A size, shape, and structure of the recording medium are appropriately selected depending on the intended purpose without any limitation.

Examples of the first toner in the second printed matter include a cyan toner, a magenta toner, and a yellow toner. Among them, a cyan toner is preferable.

Examples of the second toner in the second printed matter include a cyan toner, a magenta toner, and a yellow toner. Among them, a yellow toner is preferable.

Examples of the secondary color of the second printed matter, or the third printed matter include red, green, and blue. Among them, green is preferable. The green has a larger change in chroma than red and blue, due to a slight change in the formation state of an image. Therefore, the secondary color of the printed matter having excellent chroma is suitable as a green fixed toner image.

(Image Forming Apparatus and Image Forming Method)

The image forming apparatus of the present invention contains at least an electrostatic latent image bearing member (may be also referred to as a "photoconductor" hereinafter), an electrostatic latent image forming unit, and a developing unit, and may further contain other unit according to the necessity.

The image forming method of the present invention contains at least an electrostatic latent image forming step, and a developing step, and may further contain other steps according to the necessity.

The image forming method is suitably carried out by the image forming apparatus, the electrostatic latent image forming step is suitably performed by the electrostatic latent image forming unit, the developing step is suitably performed by the developing unit, and the aforementioned other steps are suitably performed by the aforementioned other units.

<Electrostatic Latent Image Bearing Member>

A material, structure, and size of the electrostatic latent image bearing member are appropriately selected from those known in the art. Examples of the material thereof include: an inorganic photoconductor, such as amorphous silicon, and selenium; and an organic photoconductor, such as polysilane, and phthalopolymethine. Among them, the amorphous silicon is preferable in view of long service life.

As for the amorphous silicon photoconductor, for example, a photoconductor having a photoconductive layer formed of a-Si, which is formed by heating a support to 50° C. to 400°, and forming the photoconductive layer on the support by vacuum vapor deposition, sputtering, ion plating, thermal CVD (Chemical Vapor Deposition), photo CVD, or plasma CVD. Among them, preferred is a method for forming an a-Si deposited film on a support by plasma CVD, i.e. decomposing a raw material gas with direct current, or high frequency waves or microwave glow discharge.

The shape of the electrostatic latent image bearing member is appropriately selected depending on the intended purpose without any limitation, but it is preferably a cylinder. An outer diameter of the cylindrical electrostatic latent image bearing member is appropriately selected depending on the intended purpose without any limitation, but it is preferably 3 mm to 100 mm, more preferably 5 mm to 50 mm, and even more preferably 10 mm to 30 mm.

In the image forming method and image forming apparatus, a number of the electrostatic latent image bearing member used may be one, or two or more.

<Electrostatic Latent Image Forming Unit and Electrostatic Latent Image Forming Step>

The electrostatic latent image forming unit is appropriately selected depending on the intended purpose without any limitation, provided that it is a unit configured to form an electrostatic latent image on the electrostatic latent image bearing member. Examples thereof include a unit containing at least a charging member configured to charge a surface of the electrostatic latent image bearing member, and an exposing member configured to expose the surface of the electrostatic latent image bearing member to imagewise light.

The electrostatic latent image forming step is appropriately selected depending on the intended purpose without any limitation, provided that it contains forming an electrostatic latent image on the electrostatic latent image bearing member. For example, the electrostatic latent image forming step is carried out by, after charging a surface of the electrostatic latent image bearing member, exposing the surface of the electrostatic latent image bearing member to imagewise light, and is performed by the electrostatic latent image forming unit.

—Charging Member and Charging—

The charging member is appropriately selected depending on the intended purpose without any limitation, and examples thereof include a conventional contact charging device equipped with an electroconductive or semiconductive roller, brush, film, or rubber blade, and a non-contact charging device utilizing corona discharge, such as corotron, and scorotron.

The charging can be performed by applying a voltage to a surface of the electrostatic latent image bearing member using the charging member.

As for a shape of the charging member, other than a roller, any shape can be used, such as a magnetic brush, and a fur brush, and the shape thereof is appropriately selected depending on the specifications or embodiment of the image forming apparatus.

The charging member is not limited to the contact charging member, but use of the contact charging member is preferable, as an image forming apparatus, in which an amount of ozone generated from the charging member has been reduced, can be obtained.

—Exposing Member and Exposing—

The exposing member is appropriately selected depending on the intended purpose without any limitation, provided that it can expose the surface of the electrostatic latent image bearing member charged by the charging member to imagewise light, which corresponds to an image to be formed. Examples of the exposing member include various exposure members, such as a reproduction optical exposing member, a rod-lens array exposing member, a laser optical exposure member, and a liquid crystal shutter optical member.

The exposing can be performed, for example, by exposing the surface of the electrostatic latent image bearing member to imagewise light using the exposing member.

A light source used for the exposing member is appropriately selected depending on the intended purpose without any limitation, and examples thereof include general illuminant, such as a fluorescent lamp, a tungsten lamp, a halogen lamp, a mercury lamp, a sodium lamp, a light emitting diode (LED), a semiconductor laser (LD), and electroluminescence (EL).

In order to apply only the light having a desired wavelength range, moreover, various filters, such as a sharp-cut filter, a band pulse filter, a near infrared cut filter, a dichroic filter, an interference filter, and a color conversion filter, can be used.

Note that, in the present invention, a black light system, where imagewise exposure is performed from a back side of the electrostatic latent image bearing member, may be employed.

<Developing Unit and Developing Step>

The developing unit is appropriately selected depending on the intended purpose without any limitation, provided that it is a unit configured to develop the electrostatic latent image formed on the electrostatic latent image bearing member to form a toner image, and houses a toner.

The developing step is appropriately selected depending on the intended purpose without any limitation, provided that the step contains developing the electrostatic latent image formed on the electrostatic latent image bearing member with a toner to form a toner image. The developing step is, for example, performed by the developing unit.

The toner is the toner of the present invention.

The developing unit may be of a dry developing system, or a wet developing system.

As for the developing unit, preferred is a developing device containing a stirrer configured to stir the toner to cause frictions to thereby charge the toner, and a developer bearing member, which contains a magnetic field generating unit fixed therein, and is rotatable and configured to bear a developer including the toner on a surface thereof.

In the developing unit, for example, the toner and a carrier are mixed and stirred together to charge the toner, and the charged toner is held on a surface of a rotating magnetic roller in the form of a brush, to thereby form a magnetic brush. The magnetic roller is provided adjacent to the electrostatic latent image bearing member. Therefore, part of the toner constituting the magnetic brush formed on the surface of the magnetic roller is transferred onto a surface of the electrostatic latent image bearing member by electric suction force. As a result, the electrostatic latent image is developed with the toner, to form a toner image formed of the toner on the electrostatic latent image bearing member.

<Other Units and Other Steps>

Examples of other units include a transferring unit, a fixing unit, a cleaning unit, a diselectrification unit, a recycling unit, and a controlling unit.

Examples of other step include a transferring step, a fixing step, a cleaning step, a diselectrification step, a recycling step, and a controlling step.

—Transferring Unit and Transferring Step—

The transferring unit is appropriately selected depending on the intended purpose without any limitation, provided that it is a unit configured to transfer the toner image onto a recording medium. The transferring unit is preferably a transferring unit containing a first transferring unit configured to transfer the toner image onto an intermediate transfer member, and a second transferring unit configured to transfer the toner image, which has been transferred onto the intermediate transfer member, onto the recording medium.

The transferring step is appropriately selected depending on the intended purpose without any limitation, provided that the step contains transferring the toner image onto a recording medium. The transferring step is preferably an embodiment, in which an intermediate transfer member is used, and the toner image is primary transferred onto the intermediate transfer member, followed by secondary transferring the toner image onto the recording medium.

The intermediate transfer member is appropriately selected from conventional transfer members depending on the intended purpose without any limitation, and examples thereof include a transfer belt.

The transfer unit (the first transfer unit, the second transfer unit) is preferably a unit containing at least a transfer element configured to charge the toner image formed on the electrostatic latent image bearing member to thereby release the toner image to the side of the recording medium. Examples of the transfer element include a corona transfer element using corona discharge, a transfer belt, a transfer roller, a pressure transfer roller, and an adhesion transfer element.

—Fixing Unit and Fixing Step—

The fixing unit is appropriately selected depending on the intended purpose without any limitation, provided that it is a unit configured to fix the toner image, which has been transferred onto the recording medium. The fixing unit is preferably a conventional heat pressure member. Examples of the heat pressure member include a combination of a heat roller and a pressure roller, and a combination of a heat roller, a pressure roller and an endless belt.

The fixing step is appropriately selected depending on the intended purpose without any limitation, provided that the step contains fixing the toner image, which has been transferred onto the recording medium. For example, the fixing may be performed on the toner of each color every time the toner of each color is transferred onto the recording medium, or may be performed on the toner of all the colors in the state where the toner images of all colors are superimposed.

The fixing step can be performed by the fixing unit.

Heating performed by the heat pressure member is typically preferable performed at 80° C. to 200° C.

The bearing in the fixing is appropriately selected depending on the intended purpose without any limitation, but it is preferably 0.10 MPa to 0.40 MPa.

—Cleaning Unit and Cleaning Step—

The cleaning unit is appropriately selected depending on the intended purpose without any limitation, provided that it is a unit configured to remove the toner remained on the photoconductor. Examples thereof include a magnetic brush cleaner, an electrostatic brush cleaner, a magnetic roller cleaner, a blade cleaner, a brush cleaner, and a web cleaner.

The cleaning step is appropriately selected depending on the intended purpose without any limitation, provided that the step contains removing the toner remained on the photoconductor. For example, the cleaning step can be performed by the cleaning unit.

—Diselectrification Unit and Diselectrification Step—

The diselectrification unit is appropriately selected depending on the intended purpose without any limitation, provided that it is a unit configured to apply diselectrification bias to the photoconductor to perform diselectrification. Examples thereof include a diselectrification lamp.

The diselectrification step is appropriately selected depending on the intended purpose without any limitation, provided that the step contains applying diselectrification bias to the photoconductor to perform diselectrification. For example, the diselectrification step can be performed by the diselectrification unit.

—Recycling Unit and Recycling Step—

The recycling unit is appropriately selected depending on the intended purpose without any limitation, provided that it is a unit configured to recycle the toner, which has been removed by the cleaning unit, to the developing unit.

The recycling step is appropriately selected depending on the intended purpose without any limitation, provided that the step contains recycling the toner, which has been removed by the cleaning unit, to the developing unit. For example, the recycling step can be performed by the recycling unit.

—Controlling Unit and Controlling Step—

The controlling unit is appropriately selected depending on the intended purpose without any limitation, provided that it is configured to control operation of each unit. Examples thereof include a device, such as a sequencer, and a computer.

The controlling step is appropriately selected depending on the intended purpose without any limitation, provided that the step contains controlling operation of each unit. For example, the controlling step can be performed by the controlling unit.

One example of the image forming apparatus of the present invention is explained with reference to drawings.

The image forming apparatus illustrated in FIG. 1 contains a copier main body 150, a paper feeding table 200, a scanner 300, and an automatic document feeder (ADF) 400.

In the central part of the copier main body 150, an intermediate transfer member 50 in the form of an endless belt is provided. The intermediate transfer member 50 is rotatably supported by support rollers 14, 15, and 16 in the clockwise direction in FIG. 1. In the surrounding area of the support roller 15, an intermediate transfer member cleaning device 17 configured to remove the residual toner on the intermediate transfer member 50 is provided. To the intermediate transfer member 50 supported by the support roller 14 and the support roller 15, a tandem developing device 120, in which four image forming units 18, i.e. yellow, cyan, magenta, and black image forming units, are aligned along the traveling direction of the intermediate transfer member 50, is provided. In the surrounding area of the tandem developing unit 120, the exposing device 21 is provided. A secondary transferring device 22 is provided at the opposite side of the intermediate transfer member 50 to the side where the tandem developing device 120 is provided. In the secondary transfer device 22, a secondary transfer belt 24, which is an endless belt, is supported by a pair of rollers 23, and is designed so that transfer paper transported on the secondary transfer belt 24 and the intermediate transfer member 50 can be in contact with each other. In the surrounding area of the secondary transferring device 22, a fixing device 25 is provided. The fixing device 25 is equipped with a fixing belt 26, which is an endless belt, and a press roller 27 provided to press against the fixing belt 26.

Note that, in the tandem image forming apparatus, a sheet reverser 28 configured to reverse the transfer paper to perform image formation on both sides thereof is provided in the surrounding area of the secondary transferring device 22 and the fixing device 25.

Next, formation of a full-color image (color copy) using the tandem developing device 120 is explained. Specifically, first, a document is set on a document table 130 of the automatic document feeder (ADF) 400. Alternatively, the automatic document feeder (ADF) 400 is opened, a document is set on a contact glass 32 of the scanner 300, and then the ADF 400 is closed.

In the case where the document is set on the ADF 400, once a start switch (not illustrated) is pressed, the document is transported onto the contact glass 32, and then the scanner 300 is driven to scan the document with a first carriage 33 equipped with a light source and a second carriage 34 equipped with a mirror. In the case where the document is set on the contact glass 32, the scanner 300 is immediately driven in the same manner as mentioned. During this scanning operation, light applied from a light source of the first carriage 33 is reflected on the surface of the document, the reflected light from the document is further reflected by a mirror of the second carriage 34, and passed through an image formation lens 35, which is then received by a read sensor 36. In this manner, the color document (color image) is read, and image information of black, yellow, magenta, and cyan is obtained.

Figure 2:
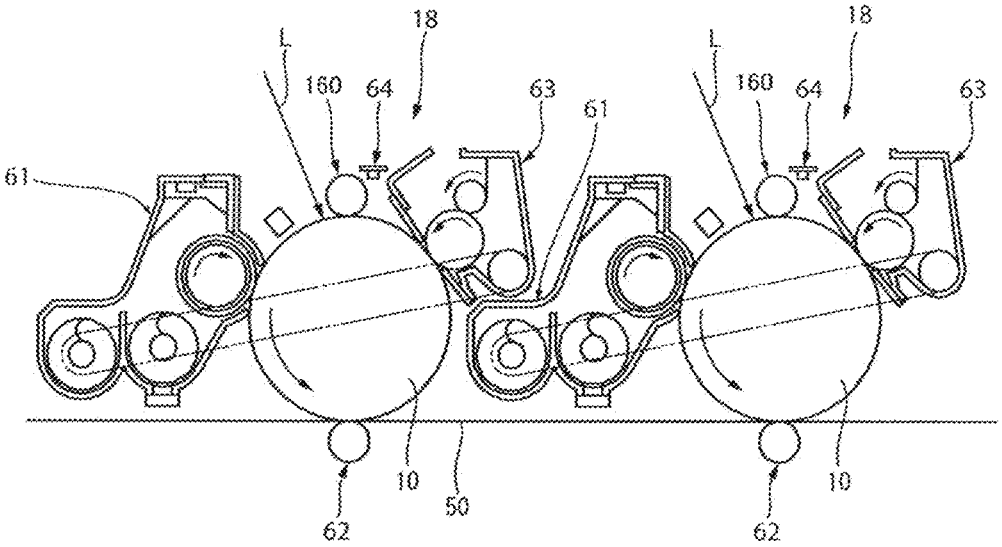
FIG. 2 is a partially enlarged view of FIG. 1.

The image information of each color, black, yellow, magenta or cyan, is transmitted to respective image forming unit 18 (a black image forming unit, a yellow image forming unit, a magenta image forming unit, and a cyan image forming unit) of the tandem developing device 120, and by each image forming unit, a respective toner image, i.e. of black, yellow, magenta, or cyan, is formed. Specifically, each image forming unit 18 (the black image forming unit, the yellow image forming unit, the magenta image forming unit, or the cyan image forming unit) of the tandem developing device 120 is, as illustrated in FIG. 2, equipped with an electrostatic latent image bearing member 10 (a black electrostatic latent image bearing member 10K, a yellow electrostatic latent image bearing member 10Y, a magenta electrostatic latent image bearing member 10M, and a cyan electrostatic latent image bearing member 10C), a charging device 160, which is the charging member configured to uniformly charge the electrostatic latent image bearing member 10, an exposing device configured to expose the electrostatic latent image bearing member to imagewise light (L in FIG. 2) corresponding to each color based on the respective color image information to form an electrostatic latent image corresponding to each color image on the electrostatic latent image bearing member, a developing device 61, which is the developing unit configured to develop the electrostatic latent image with each color toner (black toner, yellow toner, magenta toner, and cyan toner) to form a toner image of each color toner, transfer charger 62 configured to transfer the toner image onto an intermediate transfer member 50, a cleaning device 63, and a diselectrification charger 64. The image forming units can form single color images of respective color (a black image, a yellow image, a magenta image, and a cyan image) corresponding to the respective image information of respective color. The black image, yellow image, magenta image, and cyan image formed in this manner are transferred to the intermediate transfer member 50 rotatably supported by the support rollers 14, 15, and 16 in the following manner. Specifically, the cyan image formed on the cyan electrostatic latent image bearing member 10C, the yellow image formed on the yellow electrostatic latent image bearing member 10Y, the magenta image formed on the magenta electrostatic latent image bearing member 10M, and the black image formed on the black electrostatic latent image bearing member 10K are successively transferred (primary transferred) onto the intermediate transfer member 50. On the intermediate transfer member 50, the cyan image, the yellow image, the magenta image, and the black image are superimposed to form a composite color image (a color transfer image).

In the feeding table 200, meanwhile, one of the feeding rollers 142 is selectively rotated to eject a sheet (recording paper) from one of multiple feeder cassettes 144 of a paper bank 143, the ejected sheets are separated one by one by a separation roller 145 to send to a feeder path 146, and then transported by a transport roller 147 into a feeder path 148 within the copier main body 150. The sheet transported in the feeder path 148 is then bumped against a registration roller 49 to stop. Alternatively, sheets (recording paper) on a manual-feeding tray 51 are ejected by rotating a feeding roller 150, separated one by one by a separation roller 52 to guide into a manual feeder path 53, and then bumped against the registration roller 49 to stop. Note that, the registration roller 49 is generally earthed at the time of the use, but it may be biased for removing paper dust of the sheet. Next, the registration roller 49 is rotated synchronously with the movement of the composite color image (color transfer image) superimposed on the intermediate transfer member 50, to thereby send the sheet (recording paper) between the intermediate transfer member 50 and the secondary transferring device 22. The composite color image (color transfer image) is then transferred (secondary transferred) to the sheet (recording paper) by the secondary transferring device 22, to thereby form the color image on the sheet (recording paper). Note that, after transferring the image, the residual toner on the intermediate transfer member 50 is cleaned by the intermediate transfer member cleaning device 17.

The sheet (recording paper) on which the color image has been transferred is transported by the secondary transfer device 22 to send to the fixing device 25. In the fixing device 25, the composite color image (color transfer image) is fixed on the sheet (recording paper) by heat and pressure applied. Thereafter, the sheet (recording paper) is changed its traveling direction by a switch craw 55, ejected by an ejecting roller 56, and then stacked on an output tray 57. Alternatively, the sheet (recording paper) is changed its traveling direction by the switch craw 55, reversed by the sheet reverser 28 to again send to a transfer position, to thereby record an image on the back side thereof. Then, the sheet (recording paper) is ejected by the ejecting roller 56, and stacked on the output tray 57.

EXAMPLES

Examples of the present invention are explained hereinafter, but Examples shall not be construed as to limit the scope of the present invention. In the descriptions below, "part(s)" denotes "part(s) by mass" and "%" denotes "% by mass" unless otherwise stated.

Each of the measuring methods carried out in Examples are described below. The results are presented in Tables 1 to 3.

<Weight Average Molecular Weight (Mw)>

The weight average molecular weight was measured by means of a gel permeation chromatography (GPC) measuring device (e.g., GPC-8220GPC of Tosoh Corporation). As for a column used for the measurement, TSKgel Super HZM-H, 15 cm, three connected columns (of Tosoh Corporation) were used. The resin to be measured was formed into a 0.15% by mass solution using tetrahydrofuran (THF) (containing a stabilizer, manufactured by Wako Chemical Industries, Ltd.). After filtering the resulting solution with a filter having a pore size of 0.2 μm, the filtrate was provided as a sample. The obtained sample was injected in an amount of 100 μL into the measuring device, and the measurement was carried out at a flow rate of 0.45 mL/min in the environment having the temperature of 40° C. For the measurement of the molecular weight of the sample, a molecular weight of the sample was calculated from the relationship between the logarithmic value of the calibration curve prepared from a several monodisperse polystyrene standard samples and the number of counts. As for the monodisperse polystyrene standard sample, Showdex STANDARD Std. Nos. S-7300, S-210, S-390, S-875, S-1980, S-10.9, S-629, S-3.0, and S-0.580 of SHOWA DENKO K.K., and toluene were used. As the detector, a refractive index (RI) detector was used.

<Compatibility>

Whether or not the noncrystalline resin and the crystalline resin were incompatible to each other was judged by a difference between 1stTg and 2ndTg of a mixed sample.

Specifically, the noncrystalline resin and the crystalline resin were placed in a sample container formed of aluminum at a ratio (mass ratio) of 7:3, the sample container was placed on a holder unit, and then set in an electric furnace.

Subsequently, the sample was heated from 0° C. to 150° C. at the heating rate of 10° C./min in a nitrogen atmosphere.

Thereafter, the sample was cooled from 150° C. to 0° C. at the cooling rate of 10° C./min, and then again heated to 150° C. at the heating rate of 10° C./min, to thereby measure a DSC curve using a differential scanning calorimeter (DSC-60, manufactured by Shimadzu Corporation).

The DSC curve for the first heating was selected from the obtained DSC curve using an analysis program in the system of DSC-60, and endothermic shoulder 1stTg of the target sample for the first heating was determined using "endothermic shoulder temperature" in the analysis program. Moreover, the DSC curve for the second heating was selected, and endothermic shoulder 2ndTg of the target sample for the second heating was determined using "endothermic shoulder temperature" in the analysis program. When 1stTg-2ndTg was less than 5° C., it was judged that the noncrystalline resin and the crystalline resin were incompatible to each other. When 1stTg-2ndTg was 5° C. or greater, it was judged that the noncrystalline resin and the crystalline resin were compatible to each other.

<Loss Tangent>

A sample was heated from 40° C. to 150° C. at the heating speed of 2° C./min with frequency of 1.0 Hz by means of a dynamic viscoelasticity measuring device (ARES, manufactured by TA Instruments Japan Inc.), to thereby measure elastic modulus of the sample.

As for the measurement sample, a sample formed into a pellet having a thickness of 1 mm, and a diameter of 8 mm was used.

A loss tangent (tan δ) was determined from the obtained results of the storage elastic modulus (G') and loss elastic modulus (G").

<Glossiness>

<Glossiness of Primary Color>

The glossiness of the produced toner was measured in the following manner.

On a recording medium for a measurement (POD Gloss Coat, manufactured by Oji Paper Co., Ltd.) the 60° glossiness of which was 30, an unfixed solid image was formed with a deposition amount of 0.4 mg/cm$^2$. Then, the image was fixed at temperature, which was the lowest temperature +10° C., at the pressure of 0.15 MPa, with a nipping duration of 50 msec, to thereby obtain a fixed toner image. Note that, the lowest temperature was the lowest temperature in the temperature region within which loss tangent (tan δ) as measured by the dynamic viscoelasticity measurement became 6 or greater. The 60° glossiness of the obtained image was measured by means of a glossmeter (VG7000, manufactured by Nippon Denshoku Industries Co., Ltd.).

Note that, the temperature during the fixing was temperature of the toner itself, not temperature of a fixing device.

<Glossiness of Secondary Color>

The glossiness of secondary color was measured in the following manner.

On a recording medium for a measurement (POD Gloss Coat, manufactured by Oji Paper Co., Ltd.) the 60° glossiness of which was 30, an unfixed first toner image, which was a solid image formed of a first toner (a cyan toner), was formed with a deposition amount of 0.4 mg/cm$^2$. Subsequently, on the first toner image, an unfixed second toner image, which was a solid image formed of a second toner (a yellow toner), was formed with a deposition amount of 0.4 mg/cm$^2$. Then, the first toner image and second toner image were fixed at temperature, which was the lowest temperature +10° C., at the pressure of 0.15 MPa, with a nipping duration of 50 msec, to thereby obtain a fixed toner image. Note that, the lowest temperature was the lowest temperature in the temperature region within which loss tangent (tan δ) as measured by the dynamic viscoelasticity measurement became 6 or greater. The 60° glossiness of the obtained image was measured by means of a glossmeter (VG7000, manufactured by Nippon Denshoku Industries Co., Ltd.).

<Brightness Standard Deviation σr>

The measurement of the brightness standard deviation σr was performed on the fixed toner image formed for measuring the glossiness of secondary color, in the following manner.

A dark field image of the formed secondary color image was taken by means of a scanning system including a system microscope BX51 for researches (manufactured by Olympus Corporation, magnification of objective lens: ×10) and Magnafire (manufactured by Optronics, pixel: 1280×1024).

A channel, which was to be an absorption band range of the lower layer toner, was extracted from the obtained RGB image.

(the lower layer toner being cyan→R channel, the lower layer tone being magenta→G channel, the lower layer toner being yellow→B channel)

The standard deviation of the value of the brightness of the extracted channel was calculated.

The measurement was performed on three positions, and the average value thereof was determined as brightness standard deviation σr.

Figure 3:
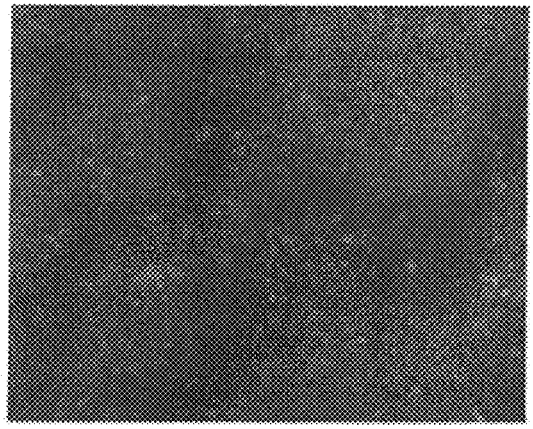
FIG. 3 is a photograph of the fixed toner image obtained in Example 7.
Figure 4:
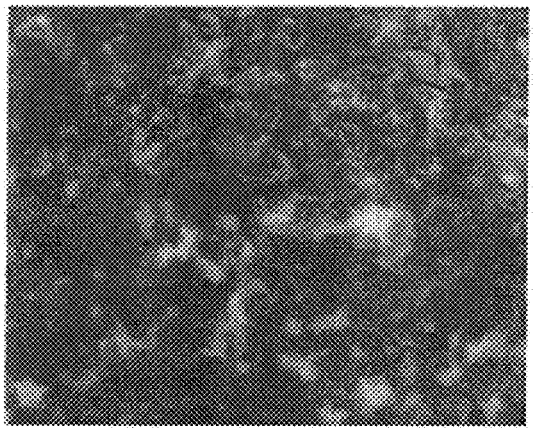
FIG. 4 is a photograph of the fixed toner image obtained in Comparative Example 11.

Note that, examples of photographs of the sample used in the measurement of the brightness standard deviation σr are depicted in FIGS. 3 and 4.

Example 1

Production of Cyan Toner 1

| -Formulation of Mixture - | |
|---|---|
| Noncrystalline Polyester Resin A (EXL-003, manufactured by Sanyo Chemical Industries, Ltd., Tg: 61° C., Mw: 5,500, main ingredients: bisphenol A and adducts thereof, aromatic polyvalent fatty acid) | 70 parts |
| Crystalline Polyester Resin A (Tm: 66° C., Mw: 110,000, components: 49 mol % of sebacic acid, 49 mol % of 1,6-hexanediol, and 2 mol % of hexamethylene diisocyanate (urethane adduct)) | 30 parts |
| Synthesis ester wax (LW-13, manufactured by Sanyo Chemical Industries, Ltd.) | 5 parts |
| Charge controlling agent (E-84, manufactured by ORIENT CHEMICAL INDUSTRIES CO., LTD.) | 1 part |
| Copper phthalocyanine blue (FSJ-SD P.B. 15:3, manufactured by DIC Corporation) | 5 parts |

The materials of the formulation above were mixed by means of HENSCHEL MIXER, and the obtained mixture was kneaded by means of an open two-roll continuous kneader, Kneadex (manufactured by Nippon Cole & Engineering Co., Ltd.), to thereby obtain the kneaded product.

Note that, the open two-roll continuous kneader used had a roll outer diameter of 0.14 m, and effective roll length of 0.8 m, and the operation conditions thereof was set as follows. The rotational speed of the heating roll was 34 rpm (rim speed: 4.8 m/min), the rotational speed of the cooling roll was 29 rpm (rim speed: 4.1 m/min), and a gap between rolls was 0.2 mm. As for the temperature of the heating medium and cooling medium inside the rolls, the temperature was set so that the temperature of the heating roll at the side of the raw material inlet was 125° C., the temperature of the heating roll at the side of the kneaded product outlet was 75° C., the temperature of the cooling roll at the side of the raw material inlet was 35° C., and the temperature of the cooling roll at the side of the kneaded product outlet was 30° C. Moreover, the feeding speed of the raw material mixture was 5 kg/hour.

Subsequently, the obtained kneaded product was cooled in the art, followed by roughly pulverizing the kneaded product by means of an atomizer, to thereby obtain a coarsely pulverized product having the maximum diameter of 2 mm or smaller.

The obtained coarsely pulverized product was finely pulverized by an impact type jet mill, IDS5 Type (manufactured by Nippon Pneumatic Mfg. Co., Ltd.) the wind pressure of which was adjusted to 0.5 MPa during the pulverizing, followed by classifying the finely pulverized product by means of an air classifier, DS5 Type (manufactured by Nippon Pneumatic Mfg. Co., Ltd.), to thereby obtain Cyan Toner Base Particles A having the volume median diameter (D50) of 6.5 μm±0.3 μm.

Next, to 100 parts of Cyan Toner Base Particles A, 1 part of hydrophobic silica, and 0.7 parts of hydrophobic titanium oxide were added, and the mixture was mixed by means of HENSCHEL MIXER, to thereby obtain Cyan Toner 1.

<Production of Yellow Toner 1>

Yellow Toner 1 was produced in the same manner as in the production of Cyan Toner 1, provided that, in the formulation of the mixture, 5 parts of copper phthalocyanine blue was replaced with 7 parts of an isoindoline yellow pigment (D1155 P.Y.185, manufactured by BASF JAPAN LTD.).

In the manners described above, Toner Set 1 composed of Cyan Toner 1 and Yellow Toner 1 was obtained.

Examples 2 to 6 Comparative Examples 1 to 8

Cyan toners and yellow toners were each produced in the same manner as in Example 1, provided that, in the formulation of the mixture, types and amounts of the noncrystalline polyester resin and the crystalline polyester resin were changed as depicted in Table 1.

TABLE 1

| | Noncrystalline polyester resin | | | | | | Crystalline polyester resin | | | |
|---|---|---|---|---|---|---|---|---|---|---|
| | First resin | Mw | Mass part | Second resin | Mw | Mass part | Type | Mw | Mass part | Compatibility |
| Ex. 1 | A | 5,500 | 70 | | None | | A | 110,000 | 30 | Incompatible |
| Ex. 2 | A | 5,500 | 80 | | None | | A | 110,000 | 20 | Incompatible |
| Ex. 3 | B | 8,000 | 70 | | None | | B | 175,000 | 30 | Incompatible |
| Ex. 4 | B | 8,000 | 80 | | None | | B | 175,000 | 20 | Incompatible |
| Ex. 5 | A | 5,500 | 70 | | None | | B | 175,000 | 30 | Incompatible |
| Ex. 6 | A | 5,500 | 80 | | None | | B | 175,000 | 20 | Incompatible |
| Comp. Ex. 1 | A | 5,500 | 100 | | None | | None | | 0 | — |
| Comp. Ex. 2 | A | 5,500 | 50 | C | 14,000 | 50 | None | | 0 | — |
| Comp. Ex. 3 | A | 5,500 | 80 | D | 87,000 | 20 | None | | 0 | — |
| Comp. Ex. 4 | B | 8,000 | 70 | | None | | C | 80,000 | 30 | Compatible |
| Comp. Ex. 5 | B | 8,000 | 80 | | None | | D | 200,000 | 20 | Incompatible |
| Comp. Ex. 6 | B | 8,000 | 70 | | None | | A | 110,000 | 30 | Compatible |
| Comp. Ex. 7 | B | 8,000 | 85 | | None | | A | 110,000 | 15 | Compatible |
| Comp. Ex. 8 | B | 8,000 | 60 | | None | | B | 175,000 | 40 | Incompatible |

In Table 1, Noncrystalline Polyester Resins B, C, and D, and Crystalline Polyester Resins B, C, and D are as follows.

Noncrystalline Polyester Resin B: EXL-101, manufactured by Sanyo Chemical Industries, Ltd., Tg: 60° C., Mw: 8,000, main components (bisphenol A-PO adduct, bisphenol A-EO adduct, aromatic polyvalent fatty acid)

Noncrystalline Polyester Resin C: RN-300, manufactured by Kao Corporation, Tg: 64° C., Mw: 14,000, main components (bisphenol A-PO adduct, bisphenol A-EO adduct, aromatic polyvalent fatty acid)

Noncrystalline Polyester Resin D: RN-290, manufactured by Kao Corporation, Tg: 60° C., Mw: 87,000, main components (bisphenol A-PO adduct, bisphenol A-EO adduct, fumaric acid, trimellitic acid)

Crystalline Polyester Resin B: Tm: 72° C., Mw: 175,000 (components: 49 mol % of dodecanedioic acid, 49 mol % of 1,6-hexanediol, and 2 mol % of hexamethylene diisocyanate (urethane adduct))

Crystalline Polyester Resin C: Tm: 72° C., Mw: 80,000 (components: 49 mol % of dodecanedioic acid, 49 mol % of 1,6-hexanediol, and 2 mol % of hexamethylene diisocyanate (urethane adduct))

Crystalline Polyester Resin D: a prototype produced by Sanyo Chemical Industries, Ltd., Tm: 72° C., Mw: 200,000 (components: 49 mol % of dodecanedioic acid, 49 mol % of 1,6-hexanediol, and 2 mol % of hexamethylene diisocyanate (urethane adduct))

<Evaluation>

The toners obtained above were subjected to the following evaluations. The results are presented in Table 2.

<<Penetration>>

Devices: penetration testing device (manufactured by NIKKA Engineering Co., Ltd.), tapping machine, thermostat Measurement container: 30 mL screw vial The screw vial was charged with 10 g of the toner, and was set in the tapping machine. After tapping 100 times, the toner in the screw vial was stored in the thermostat of 50° C. for 24 hours, followed by leaving to stand to cool the toner.

The cap of the screw vial was removed, and the screw vial was placed in a stand of the penetration testing device.

A height of the stand was adjusted so that a measuring needle of the testing device was in contact with an outermost surface of the toner in the screw vial. At this time, a scale of a dial gauge was read, and was determined as a measurement value (a).

A brace of the measuring needle was pushed to allow the toner to free fall in the toner. The scale of the dial gauge was then read, and was determined as a measurement value (b). A difference (b-a) between the measurement values (b) and (a) was determined as penetration. The penetration was evaluated based on the following evaluation criteria. In the case where the penetration is less than 10 mm, heat resistant storage stability of the toner is insufficient.

[Evaluation Criteria]

A: 20 mm or greater

B: 10 mm or greater but less than 20 mm

C: less than 10 mm

Note that, the case where the needle was penetrated through the toner was 20 mm or greater, hence determined as "A."

<<Fixing Temperature Width>>

By means of the image forming apparatus illustrated in FIG. 1, a solid image (image size: 3 cm×8 cm) having a post-transfer toner deposition amount of 0.85 mg/cm$^2$ was formed on transfer paper (POD gloss paper, manufactured by Oji Paper Co., Ltd.), and the image was fixed with varying the temperature of the fixing belt. A surface of the obtained fixed image was scratched with a ruby needle (radius of a tip: 260 μm to 320 μm, point angle: 60°) at load of 50 g by means of a scratch drawing testing device AD-401 (manufactured by Ueshima Seisakusho Co., Ltd.). The drawn surface was strongly rubbed 5 times with fibers (HANICOT #440, manufactured by Haniron K.K.). The temperature of the fixing belt at which scraping of the image was almost nonexistent was regarded as the minimum fixing temperature. Moreover, the temperature of the fixing belt lower than the temperature at which hot offset occurred was regarded as the maximum fixing temperature. A difference between the minimum fixing temperature and maximum fixing temperature was determined as a fixing temperature width. Note that, the speed for passing through the nip of the fixing device was 280 mm/s. The results were evaluated based on the following evaluation criteria.

[Evaluation Criteria]

I: The fixing temperature width was 30° C. or greater.

II: The fixing temperature width was less than 30° C.

<<Thermal Characteristics of Toner>>

In the evaluations of the penetration and fixing temperature width, the toner evaluated as "A" in the penetration and "I" in the fixing temperature width was determined as acceptable "I." The toner of the other evaluation results in these evaluation items was determined as not acceptable "II."

<<Chroma>>

A solid image of primary color, which had been produced under the same conditions as those for the measurement of the 60° glossiness, was measured by means of X-Rite 938 (manufactured by X-Rite), and chroma of the image was calculated from the following formula.

$$\text{Chroma } c^* = \sqrt{(a^{*2} + b^{*2})}$$

As for the chroma of cyan, 63 or greater was determined as excellent (I), and less than 63 was determined as undesirable (II).

As for the chroma of yellow, 100 or greater was determined as excellent (I), and less than 100 was determined as undesirable (II).

<<Visibility>>

A solid image of primary color, which had been produced under the same conditions as those for the measurement of the 60° glossiness, was visually observed, and evaluated based on the following evaluation criteria.

[Evaluation Criteria]

A: There was no glaring, nor somberness.

B: There were slight glaring and somberness, which were however not a problem.

C: There were glaring and somberness.

TABLE 2

| | Color of toner | Temperature range where tanδ is 6 or greater | 60° glossiness | 1stTg-2ndTg |
|---|---|---|---|---|
| Ex. 1 | cyan | 105-135° C. | 36 | 0° C. |
| | yellow | 105-135° C. | 32 | 0° C. |
| Ex. 2 | cyan | 105-135° C. | 38 | 0° C. |
| | yellow | 105-135° C. | 35 | 0° C. |
| Ex. 3 | cyan | 95-120° C. | 36 | 0° C. |
| | yellow | 95-120° C. | 34 | 0° C. |
| Ex. 4 | cyan | 95-120° C. | 40 | 0° C. |
| | yellow | 95-120° C. | 38 | 0° C. |
| Ex. 5 | cyan | 105-135° C. | 32 | 0° C. |
| | yellow | 105-135° C. | 31 | 0° C. |
| Ex. 6 | cyan | 105-135° C. | 38 | 0° C. |
| | yellow | 105-135° C. | 37 | 0° C. |
| Comp. | cyan | 115-145° C. | 42 | 0° C. |
| Ex. 1 | yellow | 115-145° C. | 40 | 0° C. |
| Comp. | cyan | 170-175° C. | 38 | 0° C. |
| Ex. 2 | yellow | 170-175° C. | 36 | 0° C. |
| Comp. | cyan | 105-135° C. | 26 | 0° C. |
| Ex. 3 | yellow | 105-135° C. | 25 | 0° C. |
| Comp. | cyan | 95-120° C. | 36 | 5° C. |
| Ex. 4 | yellow | 95-120° C. | 35 | 5° C. |
| Comp. | cyan | 95-120° C. | 3 | 0° C. |
| Ex. 5 | yellow | 95-120° C. | 3 | 0° C. |
| Comp. | cyan | 95-120° C. | 40 | 8° C. |
| Ex. 6 | yellow | 95-120° C. | 39 | 8° C. |
| Comp. | cyan | 95-120° C. | 32 | 0° C. |
| Ex. 7 | yellow | 95-120° C. | 30 | 0° C. |
| Comp. | cyan | 95-120° C. | 12 | 0° C. |
| Ex. 8 | yellow | 95-120° C. | 12 | 0° C. |

TABLE 2-continued

| | Penetration | | Fixing temperature width | | Evaluation of thermal characteristics | Chroma c* | | |
|---|---|---|---|---|---|---|---|---|
| | | Evaluation | | Evaluation | of toner | | Evaluation | Visibility |
| Ex. 1 | penetrate through | A | 40° C. | I | I | 65 | I | A |
| | penetrate through | A | 40° C. | I | I | 105 | I | A |
| Ex. 2 | penetrate through | A | 40° C. | I | I | 65 | I | A |
| | penetrate through | A | 40° C. | I | I | 105 | I | A |
| Ex. 3 | penetrate through | A | 40° C. | I | I | 65 | I | A |
| | penetrate through | A | 40° C. | I | I | 105 | I | A |
| Ex. 4 | penetrate through | A | 40° C. | I | I | 65 | I | A |
| | penetrate through | A | 40° C. | I | I | 105 | I | A |
| Ex. 5 | penetrate through | A | 40° C. | I | I | 65 | I | A |
| | penetrate through | A | 40° C. | I | I | 105 | I | A |
| Ex. 6 | penetrate through | A | 40° C. | I | I | 65 | I | A |
| | penetrate through | A | 40° C. | I | I | 105 | I | A |
| Comp. Ex. 1 | 18 mm | B | 10° C. | II | II | 65 | I | A |
| | 18 mm | B | 10° C. | II | II | 105 | I | A |
| Comp. Ex. 2 | penetrate through | A | 20° C. | II | II | 65 | I | A |
| | penetrate through | A | 20° C. | II | II | 105 | I | A |
| Comp. Ex. 3 | penetrate through | A | 40° C. | I | I | 64 | I | B |
| | penetrate through | A | 40° C. | I | I | 105 | I | B |
| Comp. Ex. 4 | 6 mm | C | 5° C. | II | II | 65 | I | A |
| | 8 mm | C | 5° C. | II | II | 105 | I | A |
| Comp. Ex. 5 | penetrate through | A | 10° C. | II | II | 56 | II | C |
| | penetrate through | A | 10° C. | II | II | 93 | II | C |
| Comp. Ex. 6 | 1 mm | C | 5° C. | II | II | 65 | I | A |
| | 2 mm | C | 5° C. | II | II | 105 | I | A |
| Comp. Ex. 7 | 12 mm | B | 40° C. | I | II | 65 | I | A |
| | 15 mm | B | 40° C. | I | II | 105 | I | A |
| Comp. Ex. 8 | penetrate through | A | 40° C. | I | I | 59 | II | C |
| | penetrate through | A | 40° C. | I | I | 97 | II | C |

Examples 7 to 12 and Comparative Examples 9 to 16

An image of secondary color (green) was produced using the cyan toner and yellow toner obtained in Examples 1 to 6, and Comparative Examples 1 to 8. The 60° Glossiness and brightness standard deviation of the obtained image were measured in the aforementioned manners.

Note that, the fixed toner image obtained in Example 7 is depicted in FIG. 3, and the fixed toner image obtained in Comparative Example 11 is depicted in FIG. 4.

Moreover, the fixed toner image obtained in the measurement of 60° glossiness was also evaluated in terms of chroma and visibility in the following manners. The results are presented in Table 3.

<Chroma>

The fixed toner image was measured by X-Rite938 (manufactured by X-Rite), and chroma thereof was calculated using the following formula.

$$\text{Chroma } c^* = \sqrt{(a^{*2} + b^{*2})}$$

As for the chroma of green, 83 or greater was determined as excellent (I), less than 83 was determined as undesirable (II).

<Visibility>

The fixed toner image was visually observed, and evaluated based on the following evaluation criteria.

[Evaluation Criteria]

A: There was no glaring, nor somberness.

B: There were slight glaring and somberness, which were however not a problem.

C: There were glaring and somberness.

TABLE 3

| | Toner | Brightness standard deviation σr | 60° glossiness | Chroma c* | Evaluation | Visibility |
|---|---|---|---|---|---|---|
| Ex. 7 | Ex. 1 | 3.5 | 42 | 84 | I | A |
| Ex. 8 | Ex. 2 | 2.8 | 48 | 85 | I | A |

TABLE 3-continued

| | Toner | Brightness standard deviation σr | 60° glossiness | Chroma c* | Evaluation | Visibility |
|---|---|---|---|---|---|---|
| Ex. 9 | Ex. 3 | 3.5 | 44 | 84 | I | A |
| Ex. 10 | Ex. 4 | 3.0 | 46 | 85 | I | A |
| Ex. 11 | Ex. 5 | 3.6 | 38 | 84 | I | A |
| Ex. 12 | Ex. 6 | 2.8 | 44 | 84 | I | A |
| Comp. Ex. 9 | Comp. Ex. 1 | 3.0 | 76 | 84 | I | C |
| Comp. Ex. 10 | Comp. Ex. 2 | 2.8 | 66 | 84 | I | C |
| Comp. Ex. 11 | Comp. Ex. 3 | 4.4 | 38 | 78 | II | A |
| Comp. Ex. 12 | Comp. Ex. 4 | 2.7 | 52 | 83 | I | C |
| Comp. Ex. 13 | Comp. Ex. 5 | 4.2 | 8 | 80 | II | A |
| Comp. Ex. 14 | Comp. Ex. 6 | 2.7 | 70 | 84 | I | C |
| Comp. Ex. 15 | Comp. Ex. 7 | 2.7 | 62 | 84 | I | C |
| Comp. Ex. 16 | Comp. Ex. 8 | 4.0 | 28 | 80 | II | A |

The embodiments of the present invention are, for example, as follows:

<1> A toner, containing:

a noncrystalline resin; and a crystalline resin, wherein the crystalline resin has a weight average molecular weight of 100,000 to 180,000, wherein a temperature range of the toner, within which a loss tangent (tan δ) as measured by a dynamic viscoelasticity measurement is 6 or greater, is 20° C. or greater, and wherein a fixed toner image has 60° glossiness of 30 to 50, where the fixed toner image is obtained by forming an unfixed toner image having a deposition amount of 0.4 mg/cm$^2$ on a recording medium having 60° glossiness of 30 for a measurement, and fixing at temperature at which temperature of the toner image is a temperature higher than a lowest temperature of the temperature range by 10° C., at 0.15 MPa, for a nipping duration of 50 msec.

<2> The toner according to <1>, wherein the noncrystalline resin has a weight average molecular weight of 5,000 to 10,000.

<3> The toner according to any of <1> or <2>, wherein a mass ratio of the noncrystalline resin to the crystalline resin is 80/20 to 70/30.

<4> The toner according to any one of <1> to <3>, wherein the noncrystalline resin is a noncrystalline polyester resin, and the crystalline resin is a crystalline polyester resin.

<5> The toner according to <4>, wherein the crystalline polyester resin is a crystalline polyester resin containing a urethane bond, or a urea bond, or both thereof.

<6> A two-component developer, containing:

the toner according to any one of <1> to <5>; and a carrier.

<7> A toner set, containing:

a first toner, which is the toner according to any one of <1> to <5> containing a first colorant; and a second toner, which is the toner according to any one of <1> to <5> containing a second colorant that is in a color different from a color of the first colorant.

<8> A toner container, containing:

the toner according to any one of <1> to <5>; and a container housing the toner.

<9> Printed matter, containing:

a recording medium; and a fixed toner image formed on the recording medium, wherein the fixed toner image is formed with the toner according to any one of <1> to <5>.

<10> Printed matter, containing:

a recording medium; and a fixed toner image of secondary color, formed on the recording medium, wherein the fixed toner image is formed of a first toner, and a second toner, where the first toner is the toner according to any one of <1> to <5>, which contains a first colorant, and the second toner is the toner according to any one of <1> to <5>, which contains a second colorant that is in a color different from a color of the first colorant, and wherein the fixed toner image has a brightness standard deviation σr of less than 4.0, and a 60° glossiness of 30 to 50.

<11> Printed matter, containing:

a recording medium; and a fixed toner image of a secondary color, formed on the recording medium, wherein the fixed toner image has a brightness standard deviation σr of less than 4.0, and a 60° glossiness of 30 to 50.

<12> An image forming apparatus, containing:

an electrostatic latent image bearing member;

an electrostatic latent image forming unit configured to form an electrostatic latent image on the electrostatic latent image bearing member; and a developing unit, which contains a toner, and is configured to develop the electrostatic latent image formed on the electrostatic latent image bearing member to form a toner image, wherein the toner is the toner according to any one of <1> to <5>.

<13> An image forming method, containing:

forming an electrostatic latent image on an electrostatic latent image bearing member; and developing the electrostatic latent image formed on the electrostatic latent image bearing member with a toner to form a toner image, wherein the toner is the toner according to any one of <1> to <5>.

This application claims priority to Japanese application No. 2013-049925, filed on Mar. 13, 2013 and incorporated herein by reference.

What is claimed is:

1. A toner, comprising:

a noncrystalline polyester resin; and a crystalline polyester resin, wherein:

the crystalline polyester resin has a weight average molecular weight of 100,000 to 180,000;

a temperature range of the toner, within which a loss tangent (tanδ) as measured by a dynamic viscoelasticity measurement is 6 or greater, is 20° C. or greater;

a fixed toner image has 60° glossiness of 30 to 50, where the fixed toner image is obtained by forming an unfixed toner image having a deposition amount of 0.4 mg/cm$^2$ on a recording medium having 60° glossiness of 30 for a measurement, and fixing at temperature at which temperature of the toner image is a temperature higher than a lowest temperature of the temperature range by 10° C., at 0.15 MPa for a nipping duration of 50 msec; and the noncrystalline polyester resin and the crystalline polyester resin are incompatible.

2. The toner according to claim 1, wherein the noncrystalline polyester resin has a weight average molecular weight of 5,000 to 10,000.

3. The toner according to claim 1, wherein a mass ratio of the noncrystalline polyester resin to the crystalline polyester resin is 80/20 to 70/30.

4. The toner according to claim 1, wherein the crystalline polyester resin is a crystalline polyester resin containing a urethane bond, or a urea bond, or both thereof.

5. A two-component developer, comprising:

the toner according to claim 1; and a carrier.

6. A toner set, comprising:

a first toner, which is the toner according to claim 1 further comprising a first colorant; and a second toner, which is the toner according to claim 1 further comprising a second colorant that is in a color different from a color of the first colorant.

7. A toner container, comprising:

the toner according to claim 1; and a container housing the toner.

8. An image forming apparatus, comprising:

an electrostatic latent image bearing member;

an electrostatic latent image forming unit configured to form an electrostatic latent image on the electrostatic latent image bearing member; and a developing unit comprising the toner of claim 1, and is configured to develop the electrostatic latent image formed on the electrostatic latent image bearing member to form a toner image.

9. An image forming method, comprising:

forming an electrostatic latent image on an electrostatic latent image bearing member; and developing the electrostatic latent image formed on the electrostatic latent image bearing member with the toner of claim 1 to form a toner image.

* * * * *